US006935028B2

(12) United States Patent
Cutting

(10) Patent No.: US 6,935,028 B2
(45) Date of Patent: Aug. 30, 2005

(54) PIVOTABLE BLADE HAIR CLIPPER AND SUCTION COLLECTION SYSTEM

(76) Inventor: John Cutting, 28 Kingston Way, Cotati, CA (US) 94931-4357

( * ) Notice: Subject to any disclaimer, the term of this patent is extended or adjusted under 35 U.S.C. 154(b) by 230 days.

(21) Appl. No.: 10/371,583

(22) Filed: Feb. 24, 2003

(65) Prior Publication Data

US 2004/0006873 A1 Jan. 15, 2004

Related U.S. Application Data

(60) Provisional application No. 60/360,769, filed on Mar. 1, 2002.

(51) Int. Cl.[7] ..... B26B 19/44
(52) U.S. Cl. ..... 30/41.5; 30/526; 30/43.1
(58) Field of Search ..... 30/41.5, 526, 43.92, 30/43.1, 57, 34.1

(56) References Cited

U.S. PATENT DOCUMENTS 2,008,681 A * 7/1935 Carlson ..... 30/60
2,292,453 A * 8/1942 La Mere ..... 30/216
2,916,821 A * 12/1959 Witmer ..... 30/41.5
3,368,277 A * 2/1968 Vevea ..... 30/133
3,763,558 A * 10/1973 Bauerle ..... 30/34.1
3,911,572 A * 10/1975 Czerner et al. ..... 30/34.1
4,031,618 A * 6/1977 Mansfield ..... 30/41.5
4,667,405 A * 5/1987 Trichell et al. ..... 30/41.5
4,970,787 A * 11/1990 Watanabe et al. ..... 30/132
5,012,576 A * 5/1991 Johannesson ..... 30/29.5

* cited by examiner

*Primary Examiner*—Kenneth E. Peterson

(57) ABSTRACT

The pivotable blade hair clipper and suction collection system cuts hair from the head or any body surface, plus safely and immediately suctions away clipped hair debris. The system provides a vacuum canister, suction hose, suctionable clipper handle, pivoting blades, back-reach attachment, rolling and combing guard/gauges built-in mirror, and safety features. The vacuum switch powers the clipper motor utilizing wiring housed within the suction hose. A finger-pivoted blade assembly provides ergonomic angles for cutting the hair. Hair debris is suctioned through the clipper handle and collected in a personally sized vacuum canister. A back-reach attachment extends the clipper to hard-to-reach body surfaces. A built-in mirror encourages safely positioning the canister and hose. Safety venting nullifies nicks. Minimal external cording prevents tangled cords. Three types of guard/gauge provide conventional hair trimming, combing motion for flat surfaces, or rolling motion for comfort at the underarm and bikini.

11 Claims, 22 Drawing Sheets

*Clipper*

FIGURE 2 CLIPPER & BLADE ASSEMBLY: *PREFERRED FRONT VIEW (CUT-AWAY)*

*Clipper*
FIGURE 1 CLIPPER HANDLE AND SUCTION HOSE:
*PREFERRED ELEVATED PERSPECTIVE*
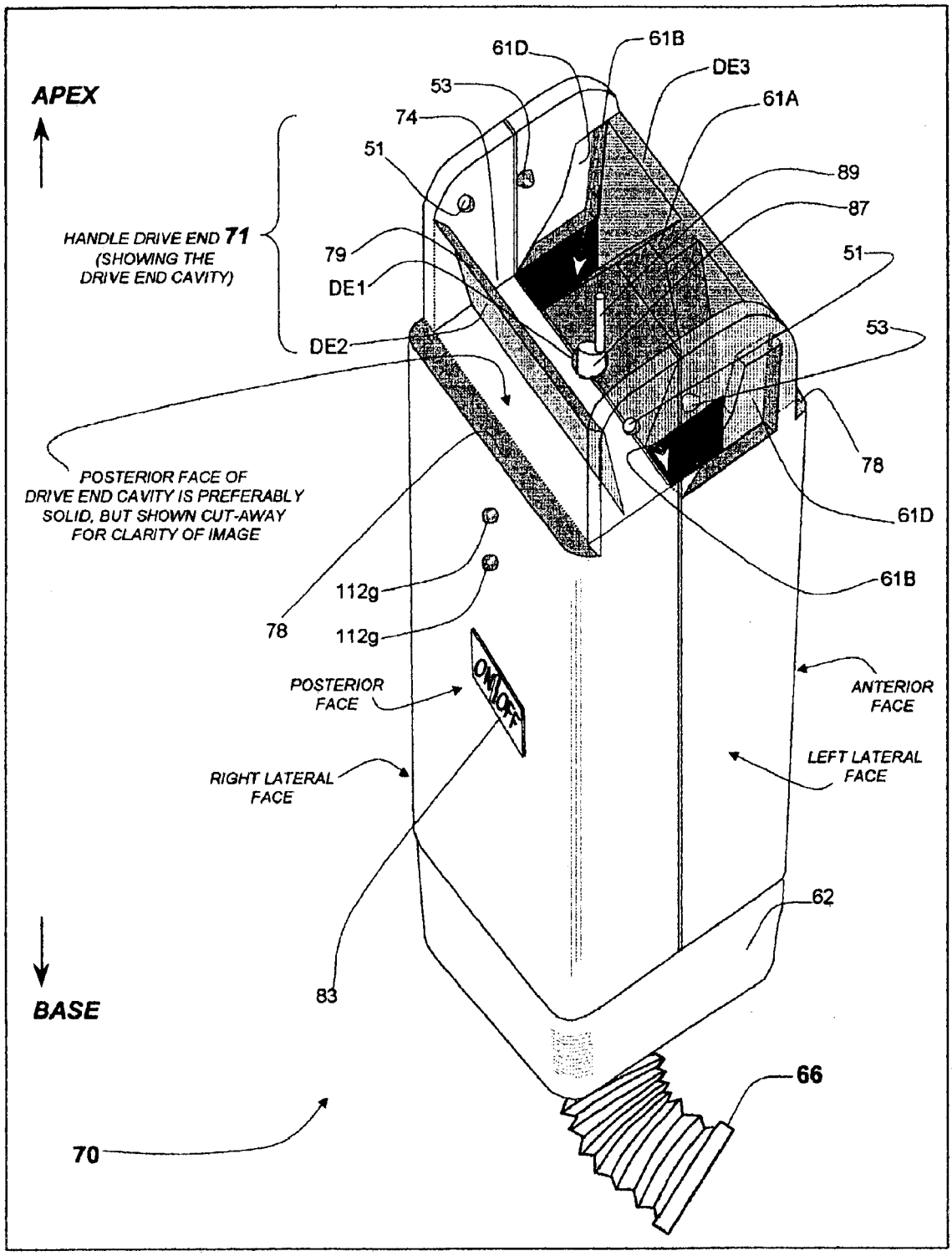

*Clipper*
FIGURE 2 CLIPPER & BLADE ASSEMBLY:
*PREFERRED FRONT VIEW (CUT-AWAY)*
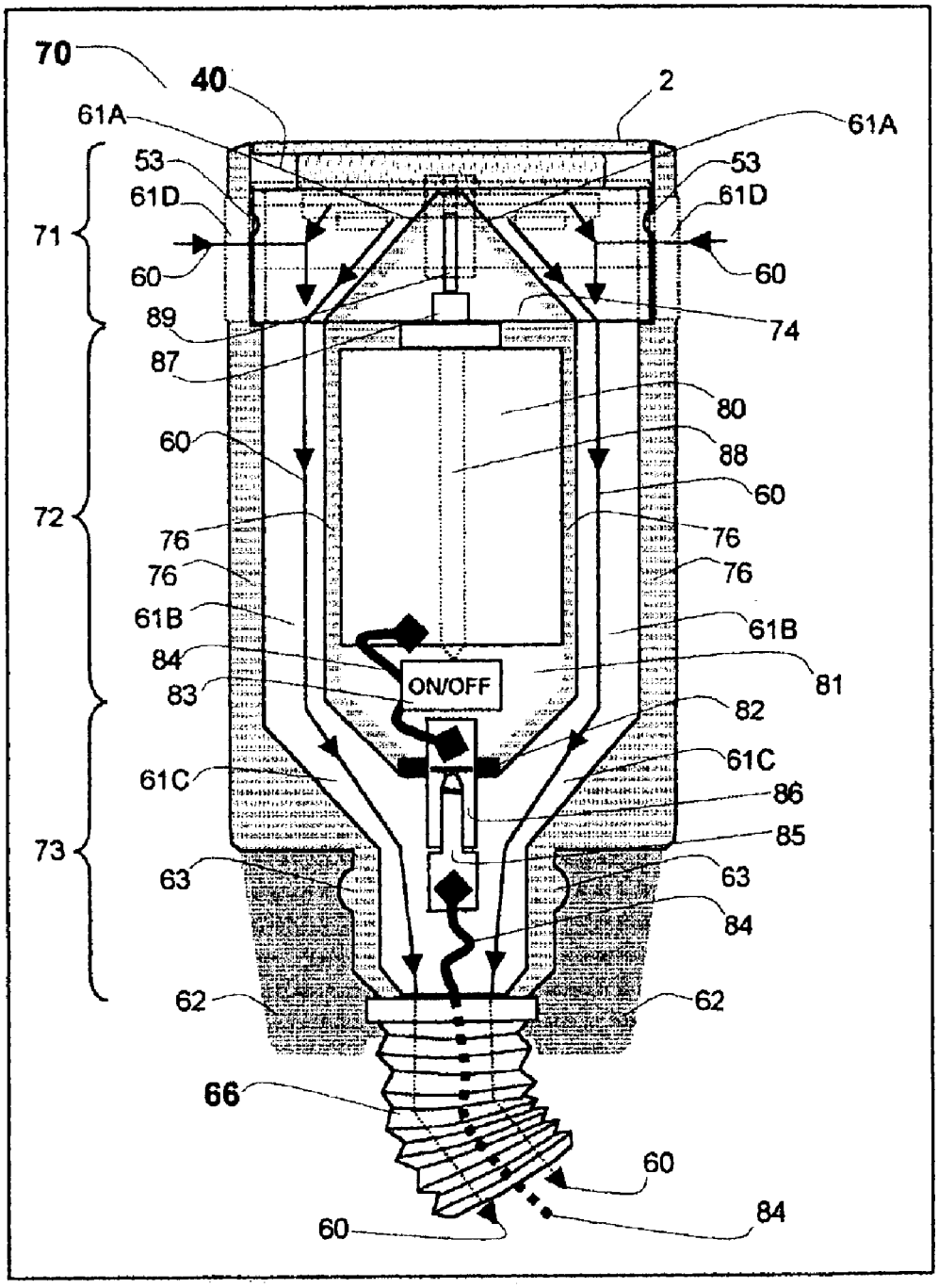

*Clipper*
FIGURE 3 CLIPPER & BLADE ASSEMBLY:
*PREFERRED SIDE VIEW (COMPONENTRY CUT-AWAY)*
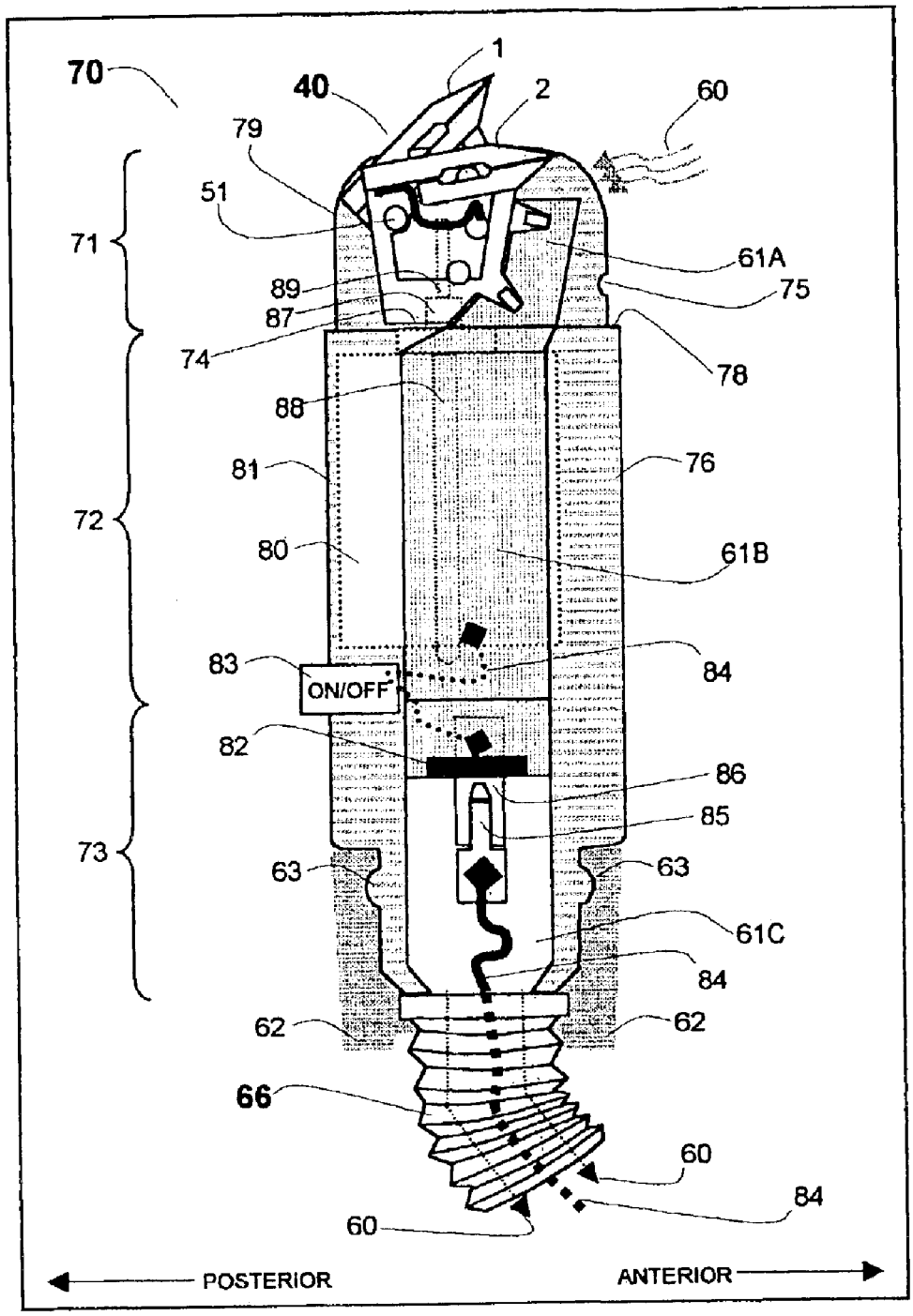

*Blade Assembly*
FIGURE 4 PIVOTABLE BLADE ASSEMBLY:
*ELEVATED PERSPECTIVE*
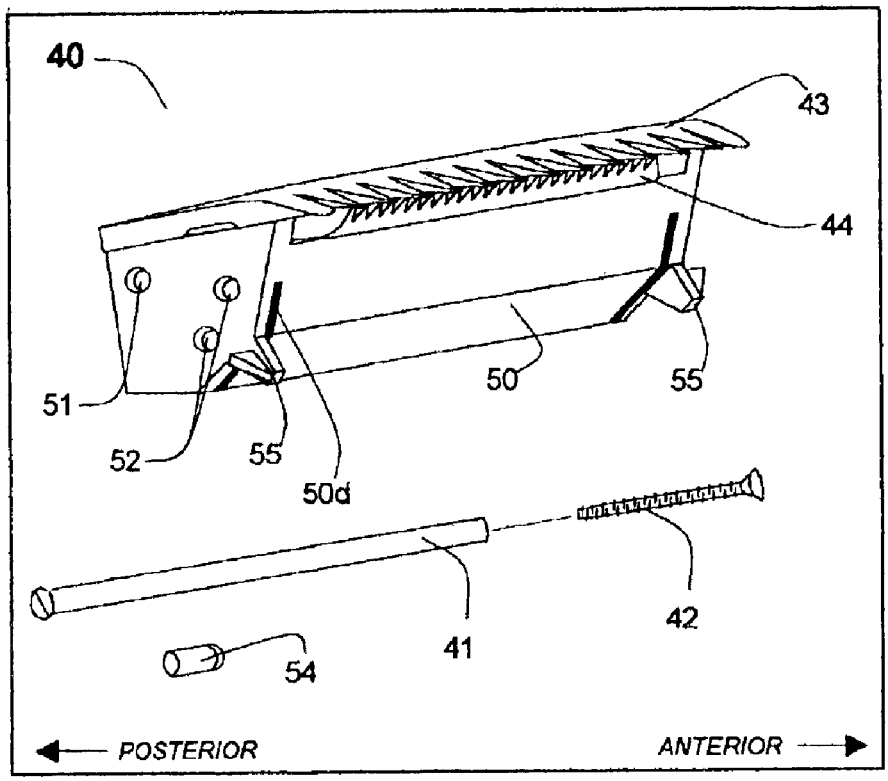

*Blade Assembly*
FIGURE 5 PIVOTABLE BLADE ASSEMBLY:
*ELEVATED PERSPECTIVE BLOW-UP*
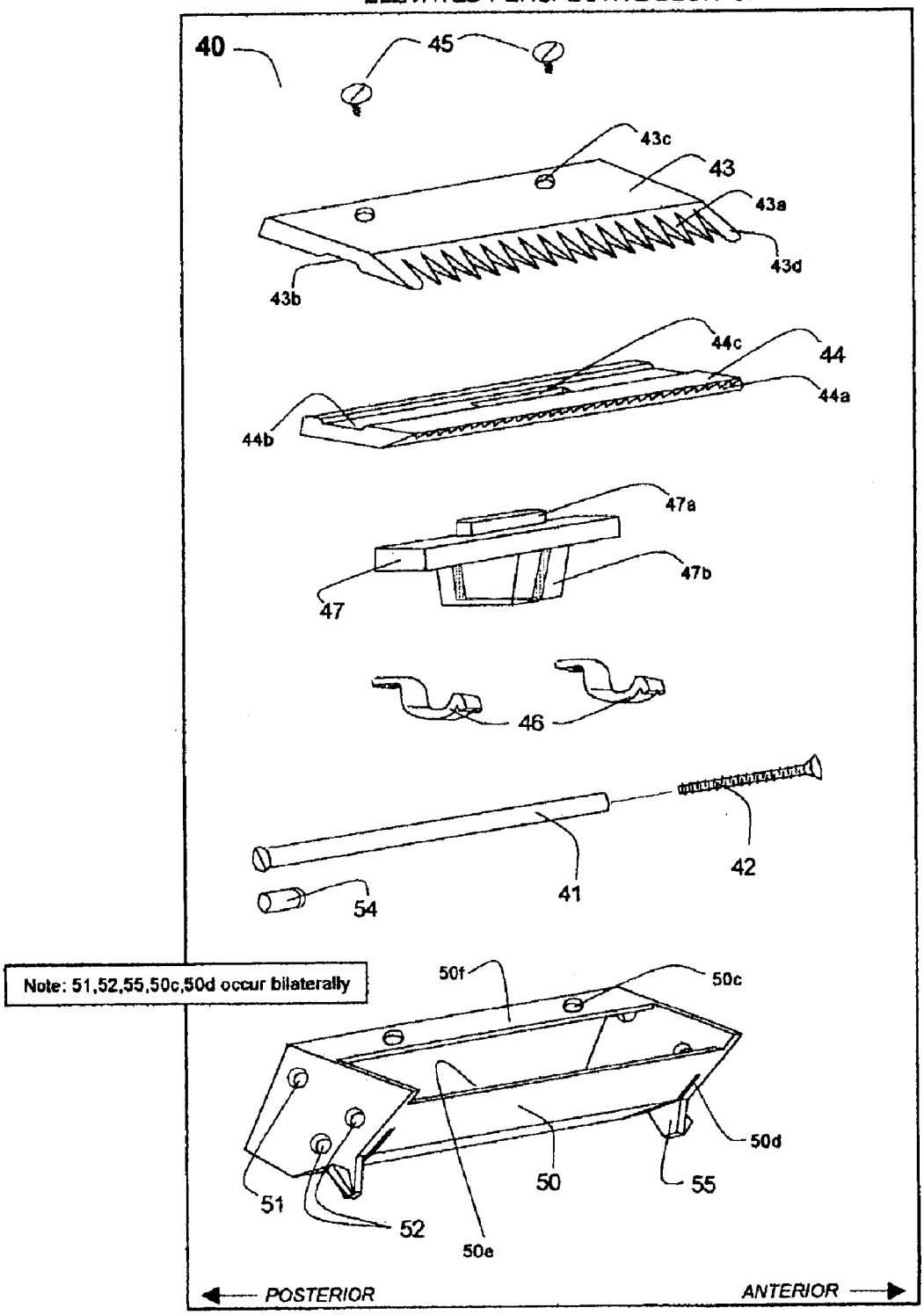

*Blade Assembly*
FIGURE 6 PIVOTABLE BLADE ASSEMBLY:
*ELEVATED PERSPECTIVE CUT-AWAY*
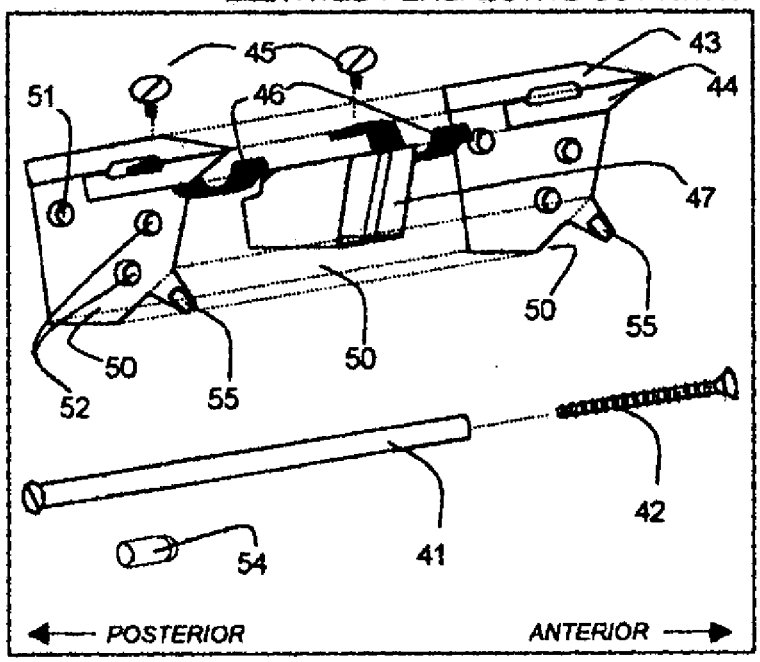
FIGURE 7 BLADE ASSEMBLY POSITIONS:
*COMPONENTRY SIDE VIEW CUT-AWAY*
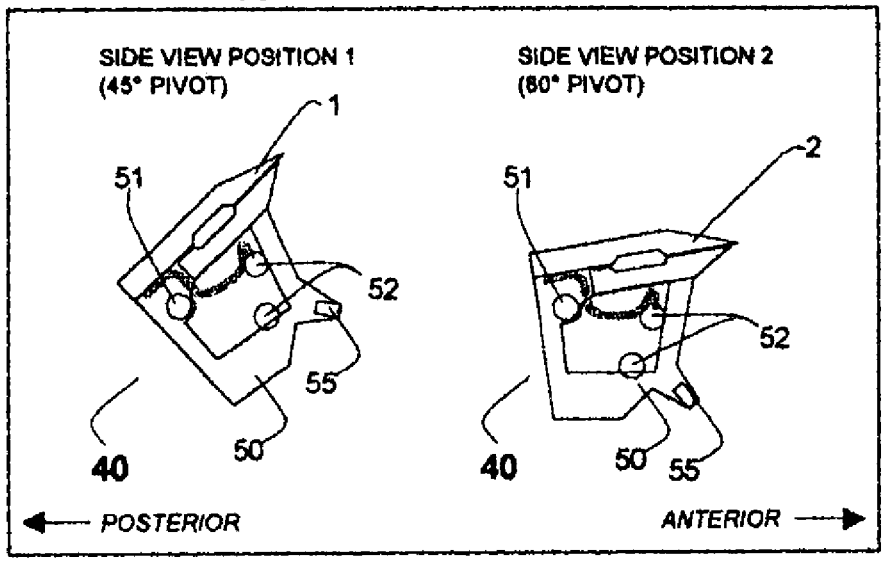

*Blade Assembly*
FIGURE 8
PIVOTABLE BLADE ASSEMBLY:
*COMPONENTRY SIDE VIEW CUT-AWAY*
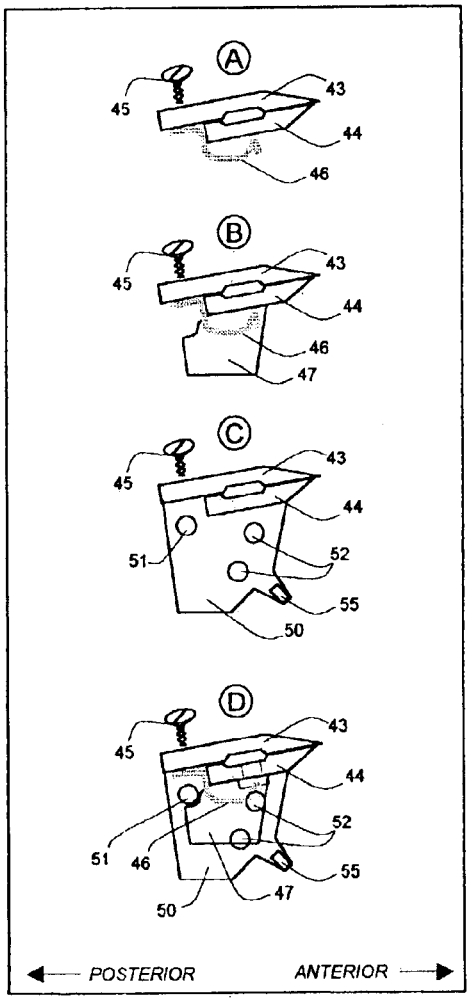
FIGURE 9 BLADE ASSEMBLY PIVOT ACTION:
*COMPONENTRY SIDE VIEW CUT-AWAY*
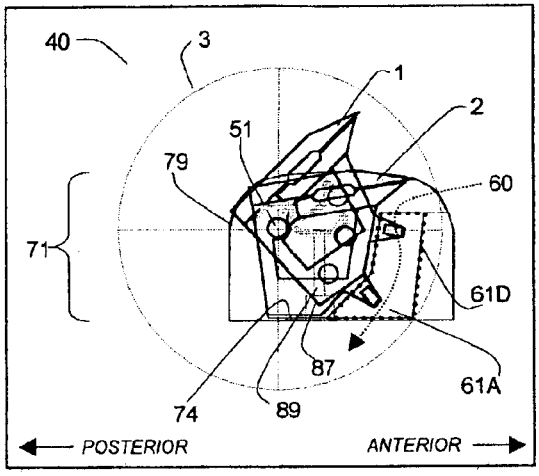
FIGURE 12 BLADE AND SPRING ATTACHMENT:
*(SIDE AND CORRESPONDING BOTTOM CUT-AWAY)*
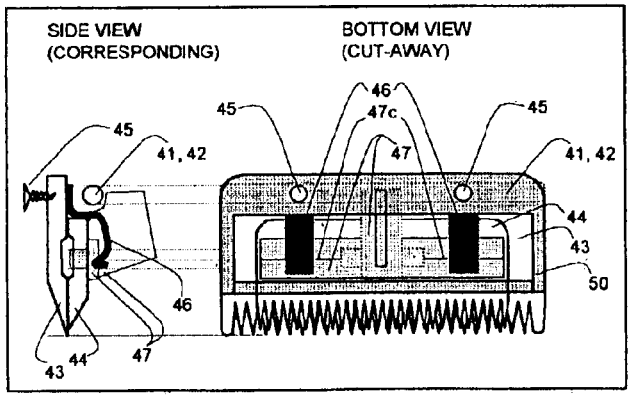

*Suction Hose*
FIGURE 13 SUCTION HOSE CONNECTIONS:
*SIDE VIEW (COMPONENTRY CUT-AWAY)*
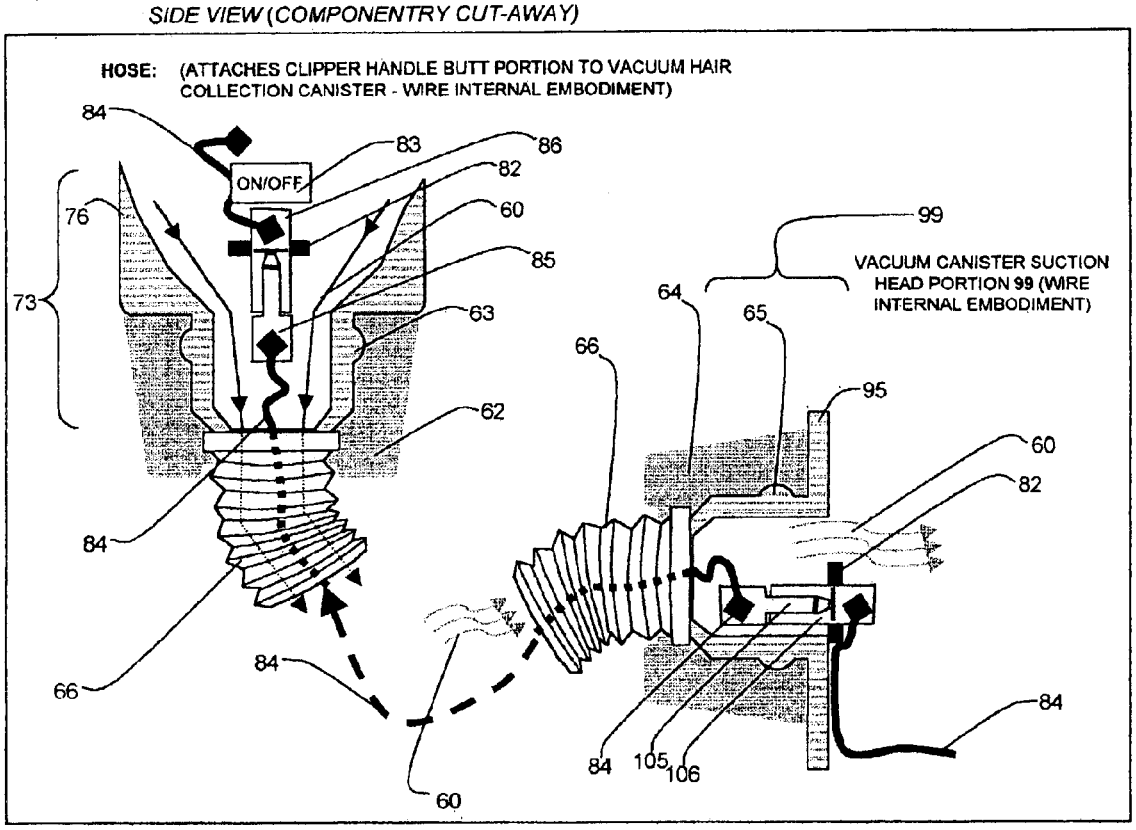

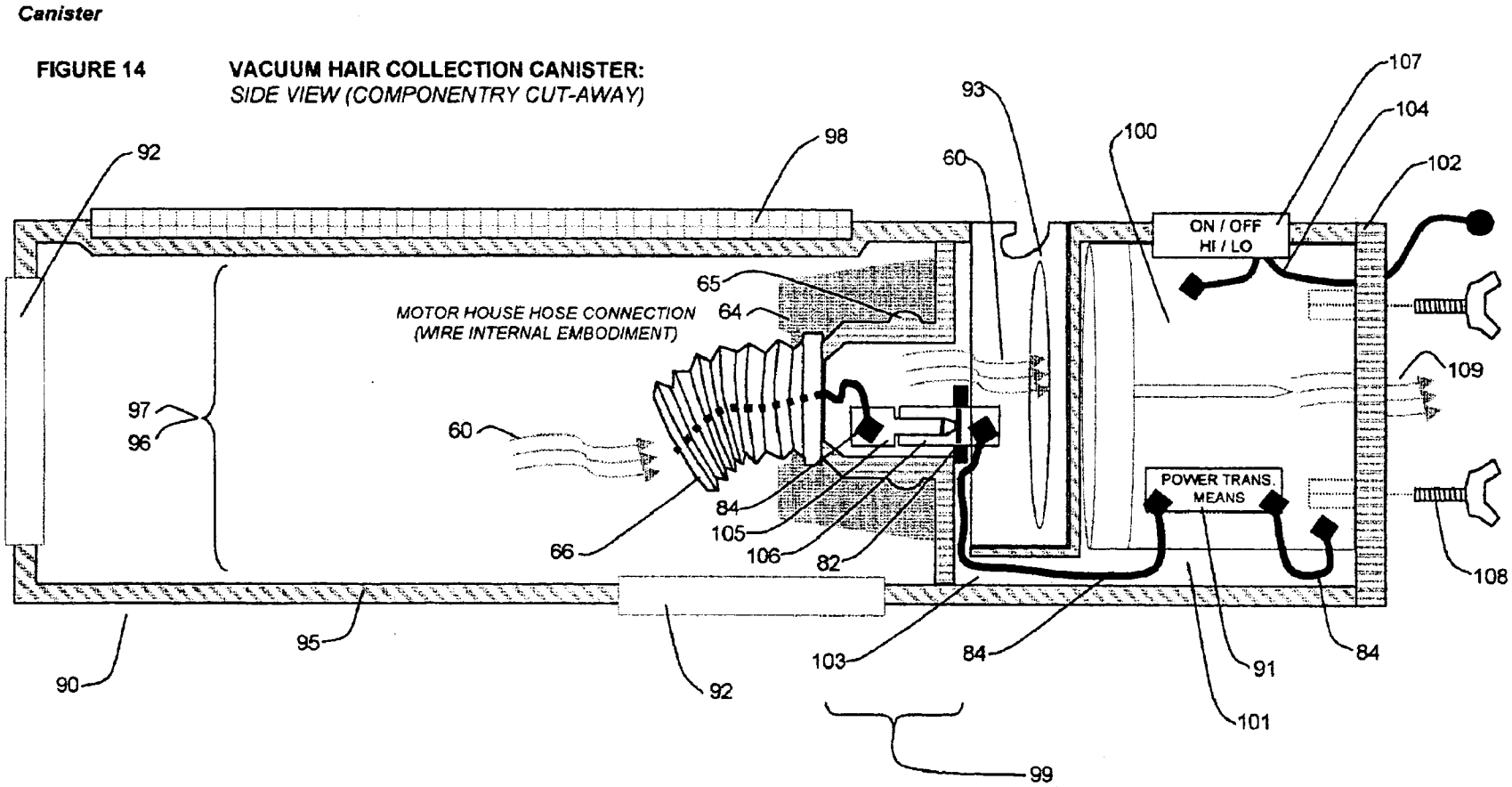
FIGURE 14 VACUUM HAIR COLLECTION CANISTER: *SIDE VIEW (COMPONENTRY CUT-AWAY)*
*Canister*

*Guard*
FIGURE 15 GUARD/GAUGE:
*SIDE OVERLAY VIEW ("ROLLING" DESIGN)*
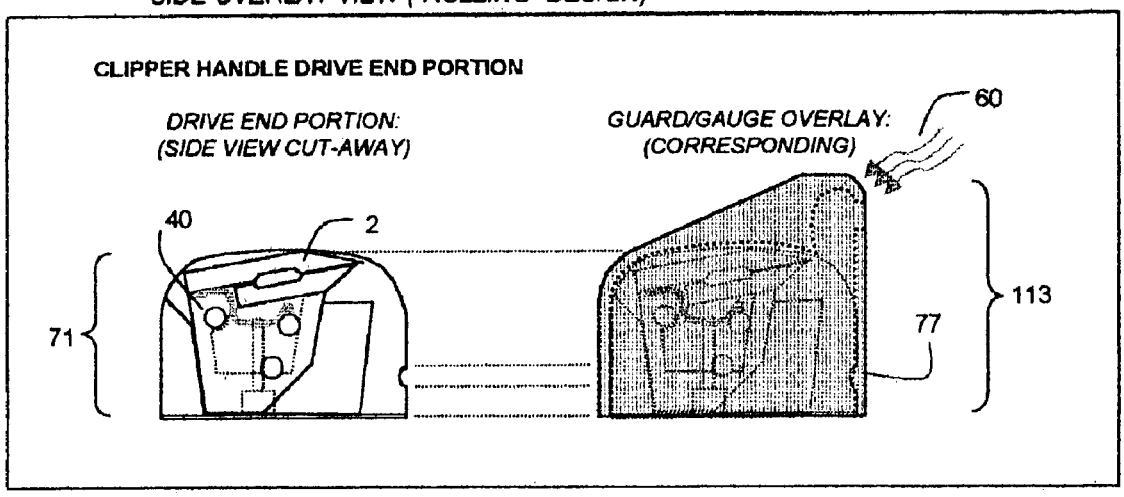
FIGURE 16 SKIN GUARD:
*ELEVATED PERSPECTIVE*
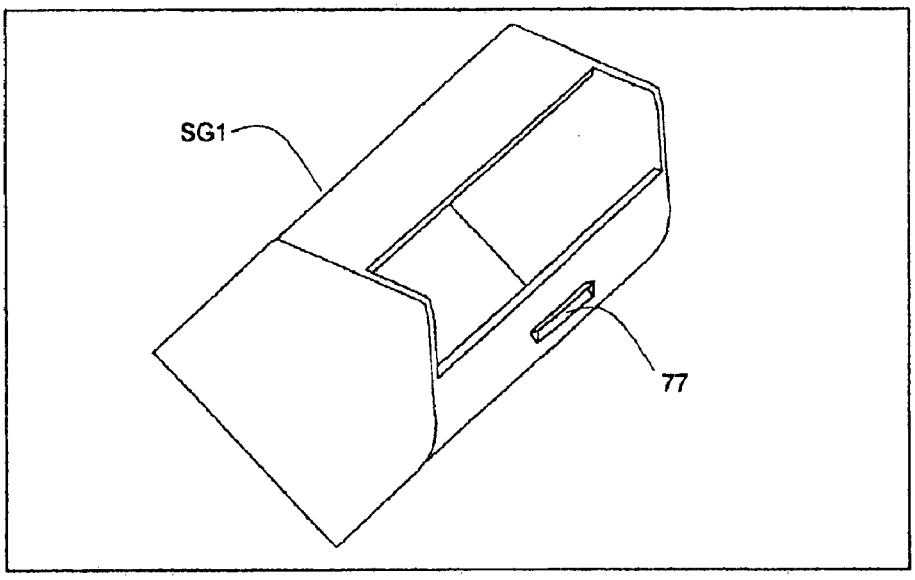

*Guard*
FIGURE 17 GUARD/GAUGE:
*ELEVATED PERSPECTIVE ("ROLLING" DESIGN)*
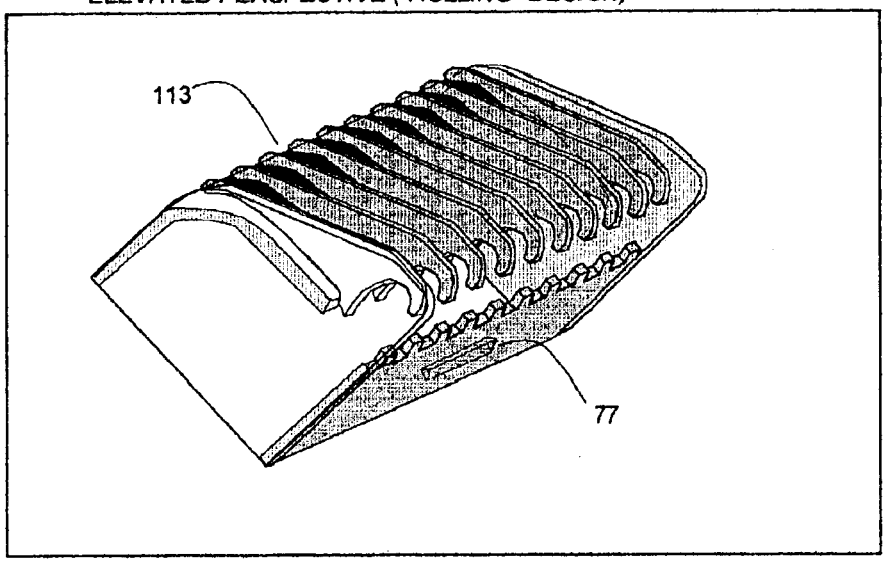
FIGURE 18 GUARD/GAUGE:
*BLOW-UP VIEW ("ROLLING" DESIGN)*
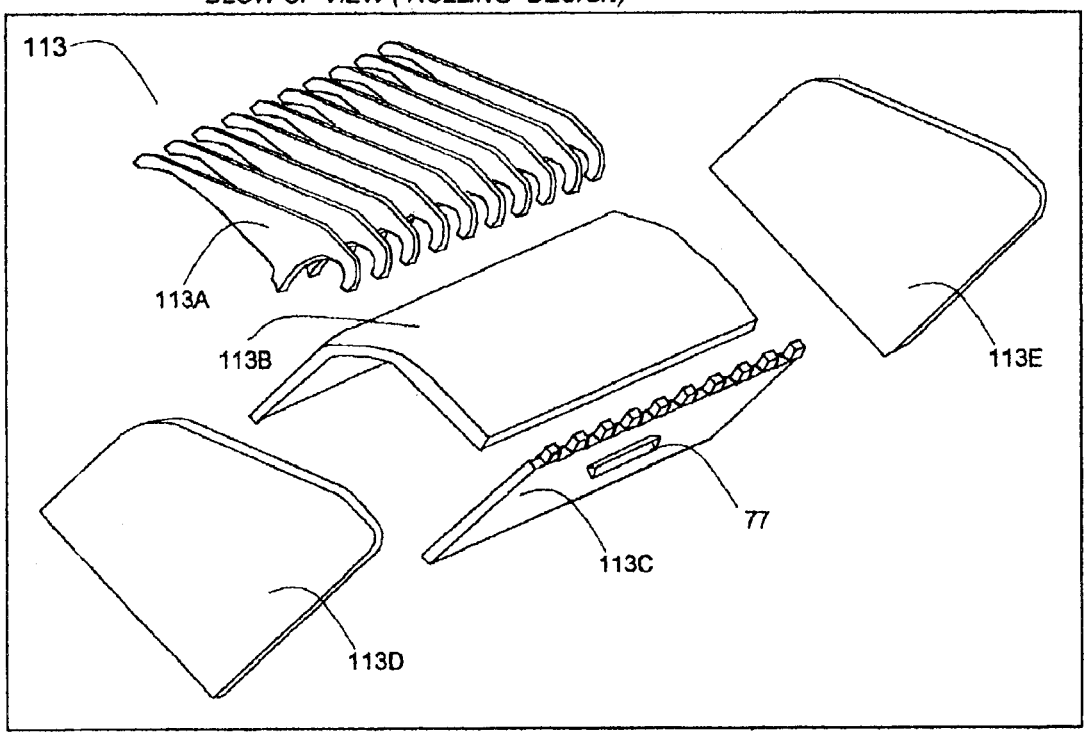

*Guard*
FIGURE 19 GUARD/GAUGE:
*SIDE OVERLAY VIEW ("BODY" DESIGN)*
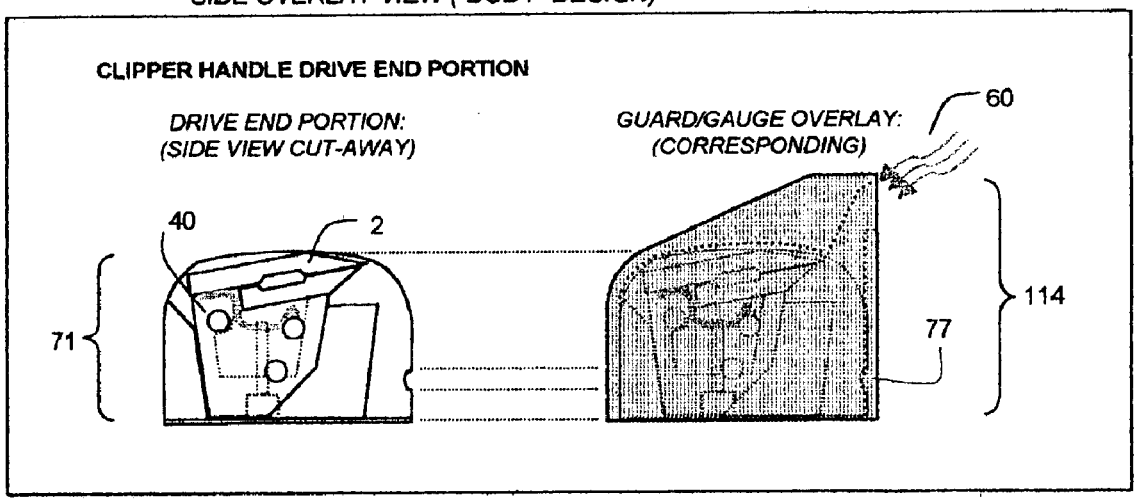
FIGURE 20 SKIN GUARD:
*SIDE OVERLAY VIEW*
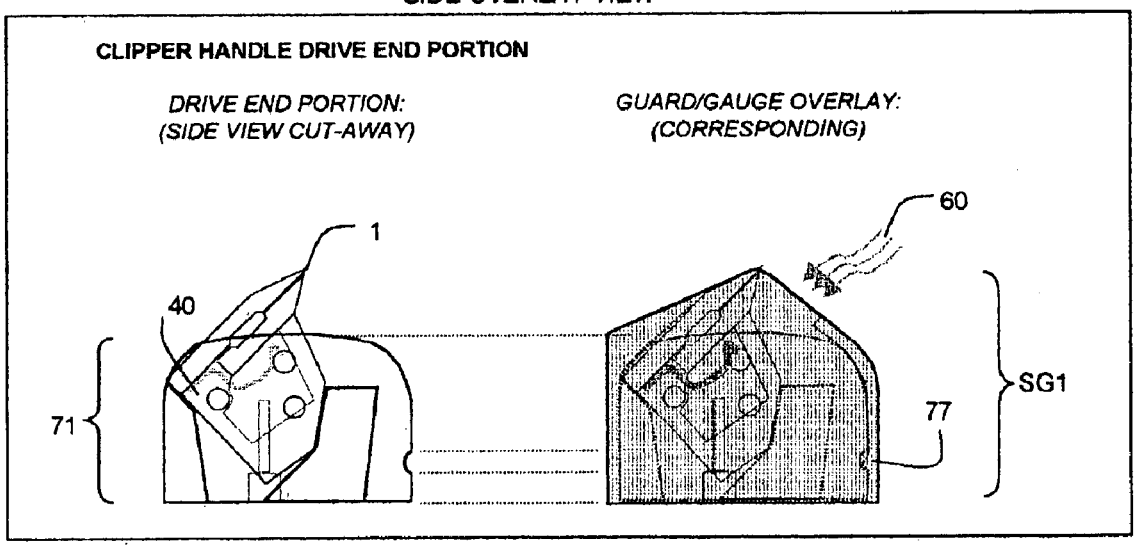

*Guard*
FIGURE 21 GUARD/GAUGE:
*ELEVATED PERSPECTIVE ("BODY" DESIGN)*
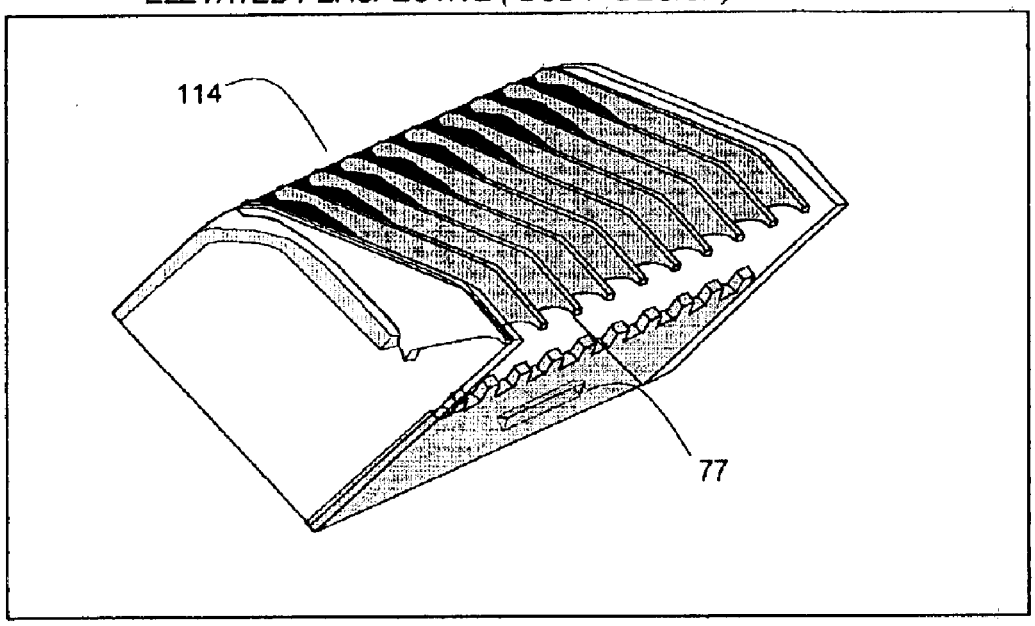

*Guard*
FIGURE 22 GUARD/GAUGE:
*BLOW-UP VIEW ("BODY" DESIGN)*
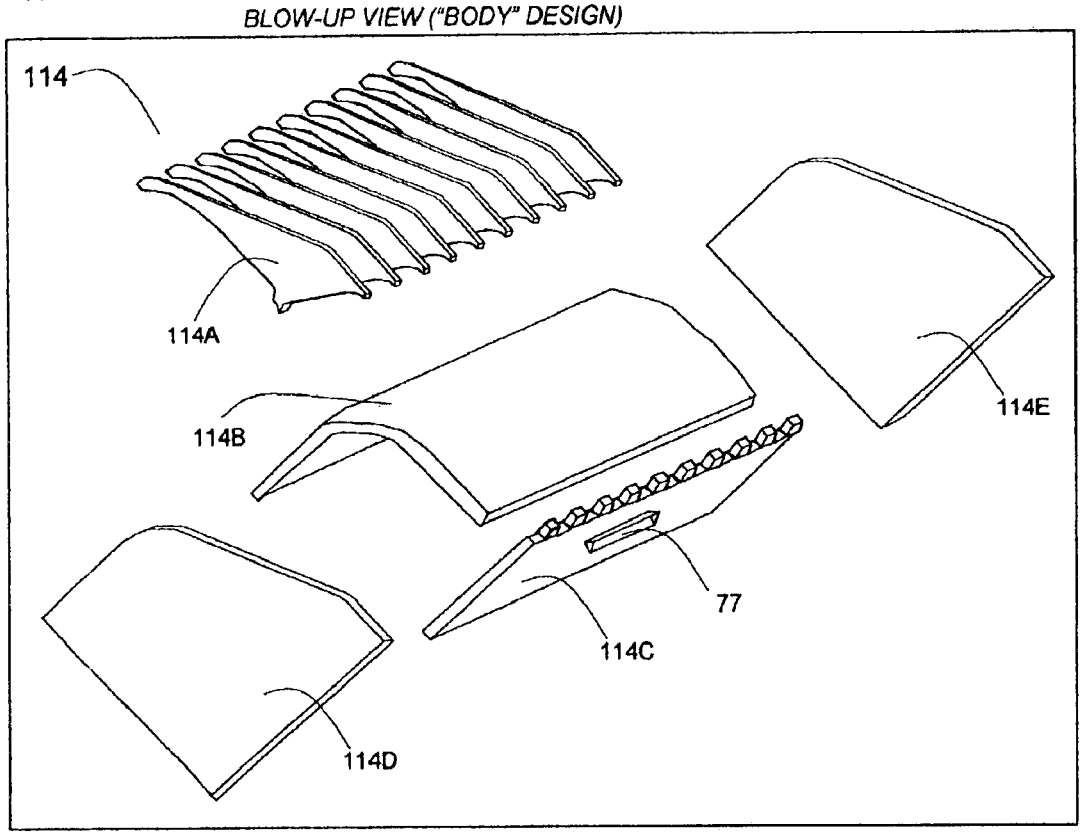
FIGURE 23 GUARD/GAUGE:
*SIDE OVERLAY VIEW ("HAIR" DESIGN)*
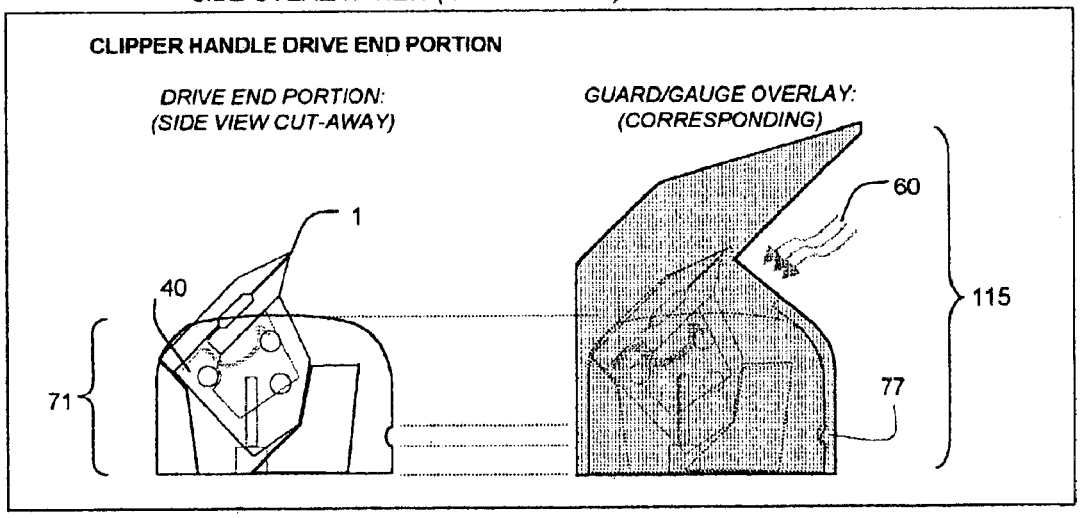

*Guard*
FIGURE 24 SKIN GUARD:
*BLOW-UP VIEW*
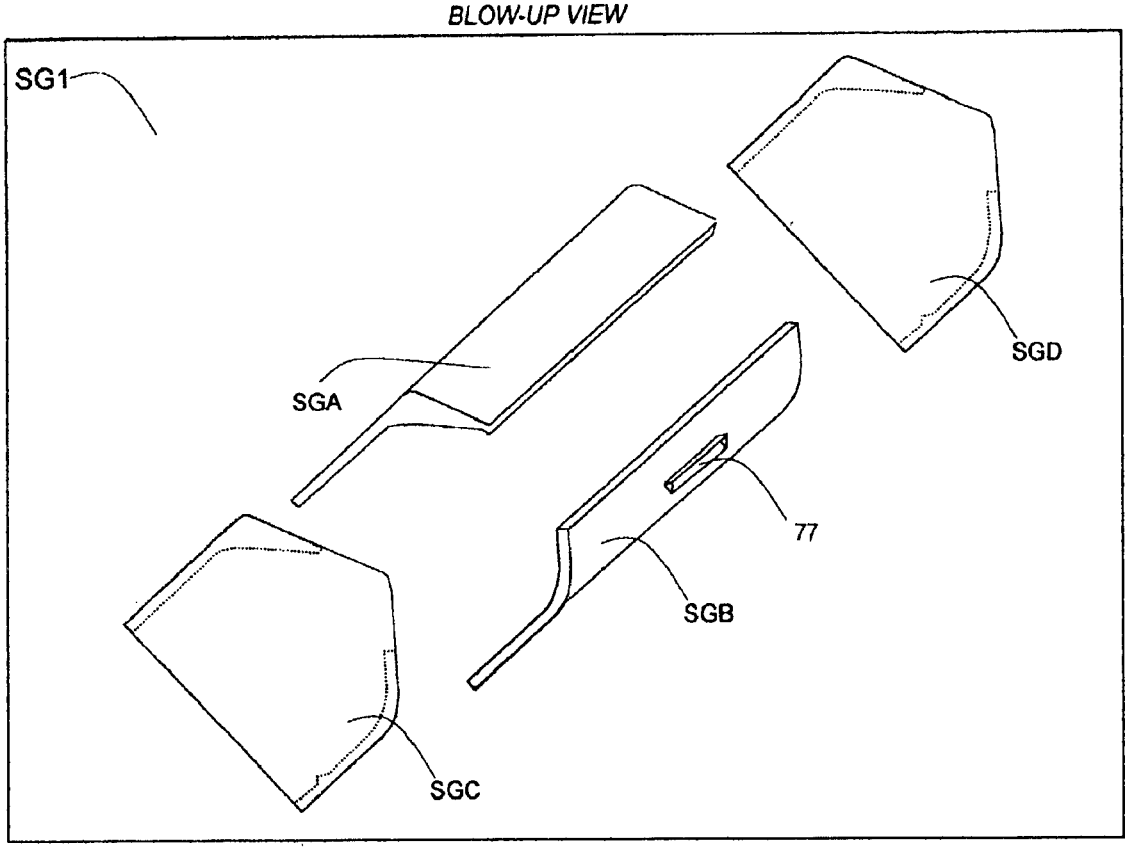
FIGURE 25 GUARD/GAUGE:
*ELEVATED PERSPECTIVE ("HAIR" DESIGN)*
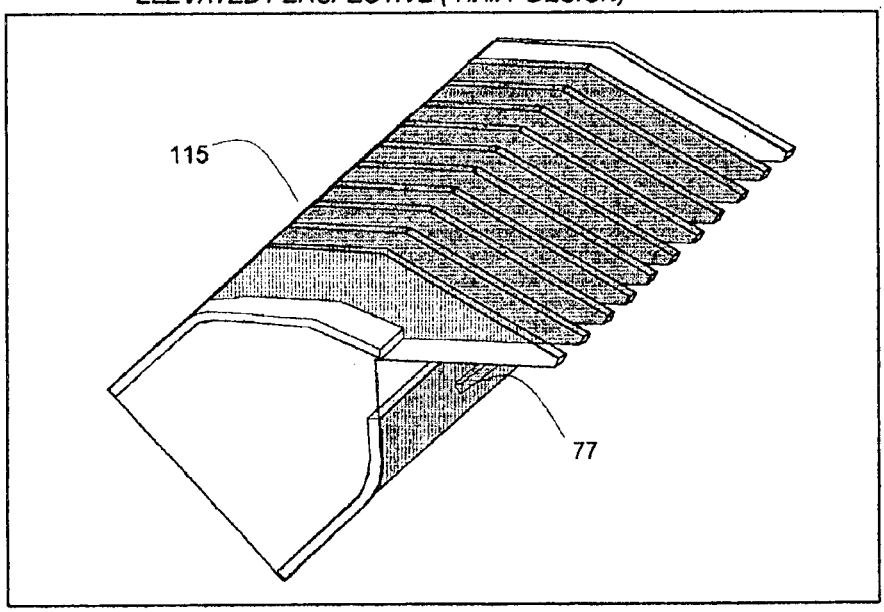

*Guard*

GUARD/GAUGE:
*BLOW-UP VIEW ("HAIR" DESIGN)*

*Back-Reach Attachment*
FIGURE 27 BACK-REACH ATTACHMENT COLLAR:
*ELEVATED PERSPECTIVE*
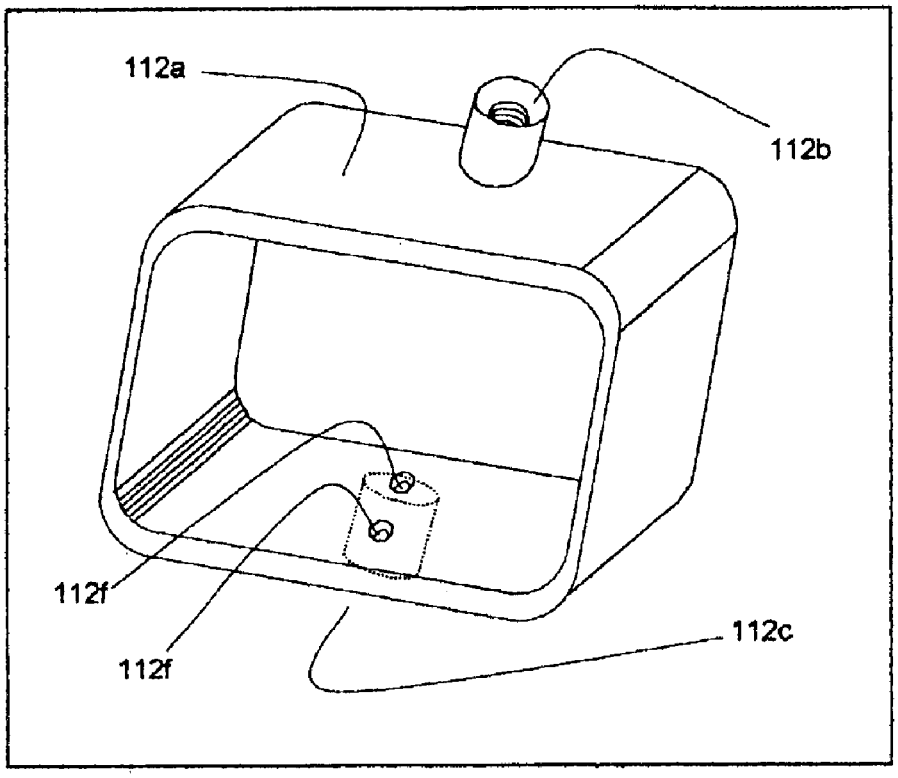

*Back-Reach Attachment*
FIGURE 27A BACK-REACH ATTACHMENT:
*SIDE VIEW (COLLAR AND ROD METHODS)*
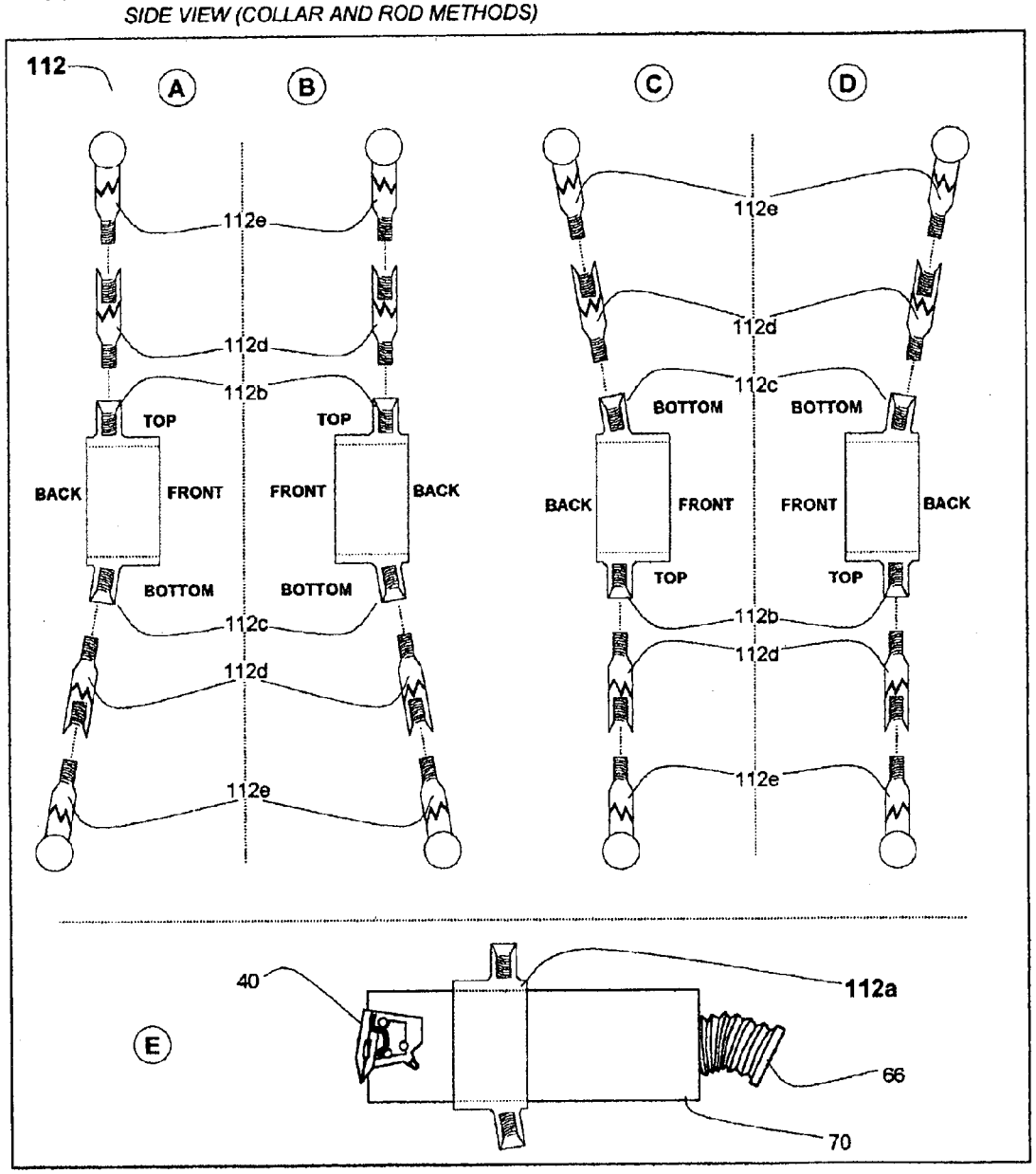

*Schematic*
FIGURE 28 PIVOTABLE BLADE HAIR CLIPPER AND SUCTION COLLECTION SYSTEM:
*SCHEMATIC DRAWING*
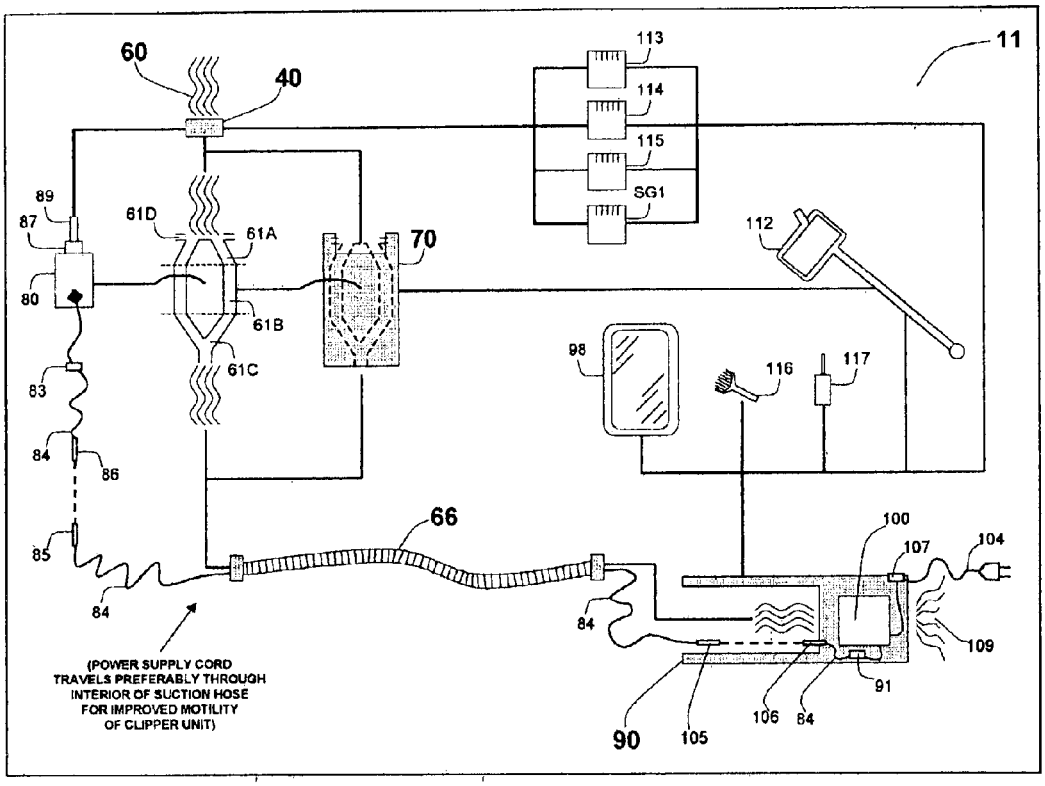

*Clipper Design*
FIGURE 29 CLIPPER HANDLE AND SUCTION HOSE:
*ELEVATED PERSPECTIVE*
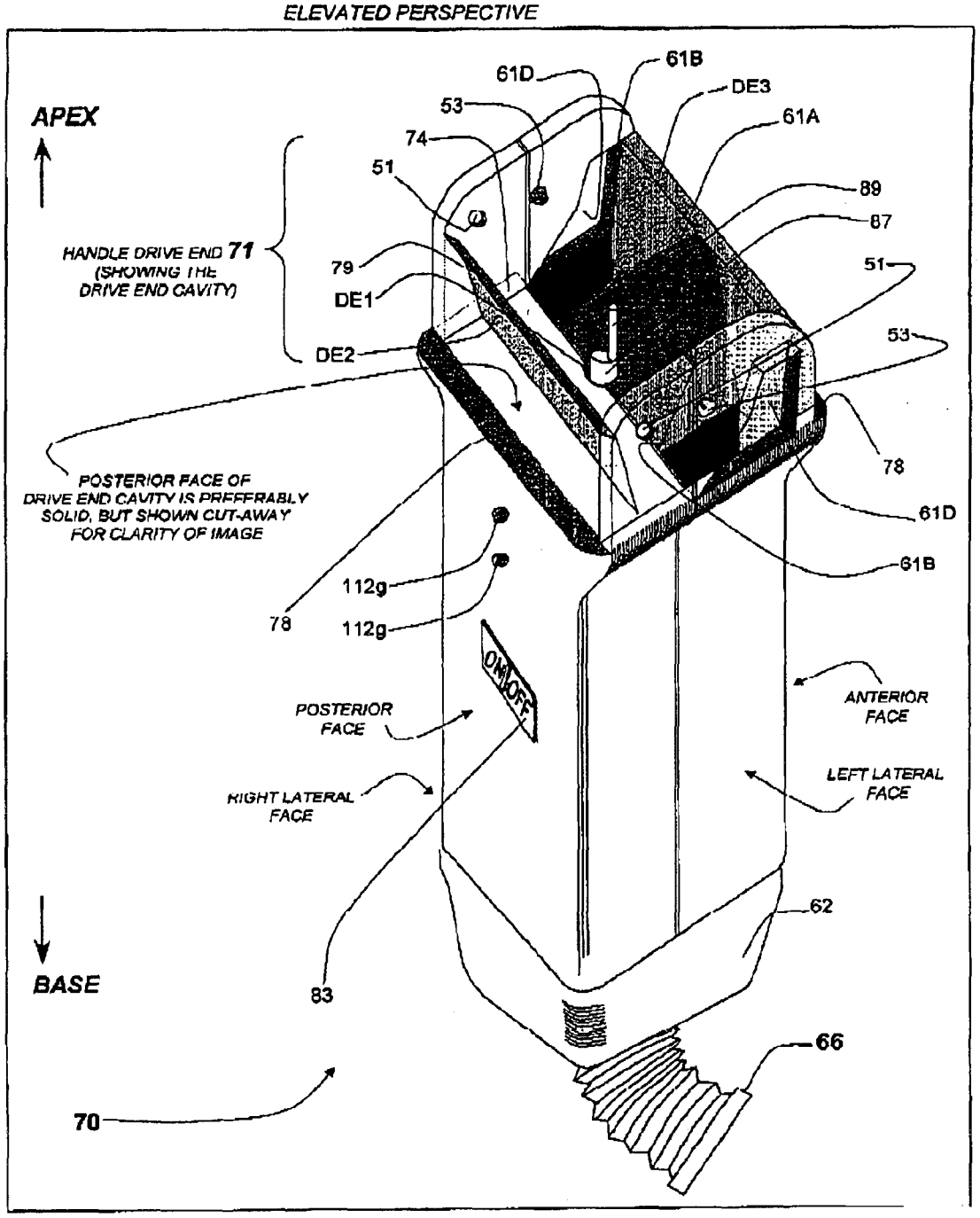

*Clipper Design*
FIGURE 30 CLIPPER & BLADE ASSEMBLY:
*FRONT VIEW (CUT AWAY)*
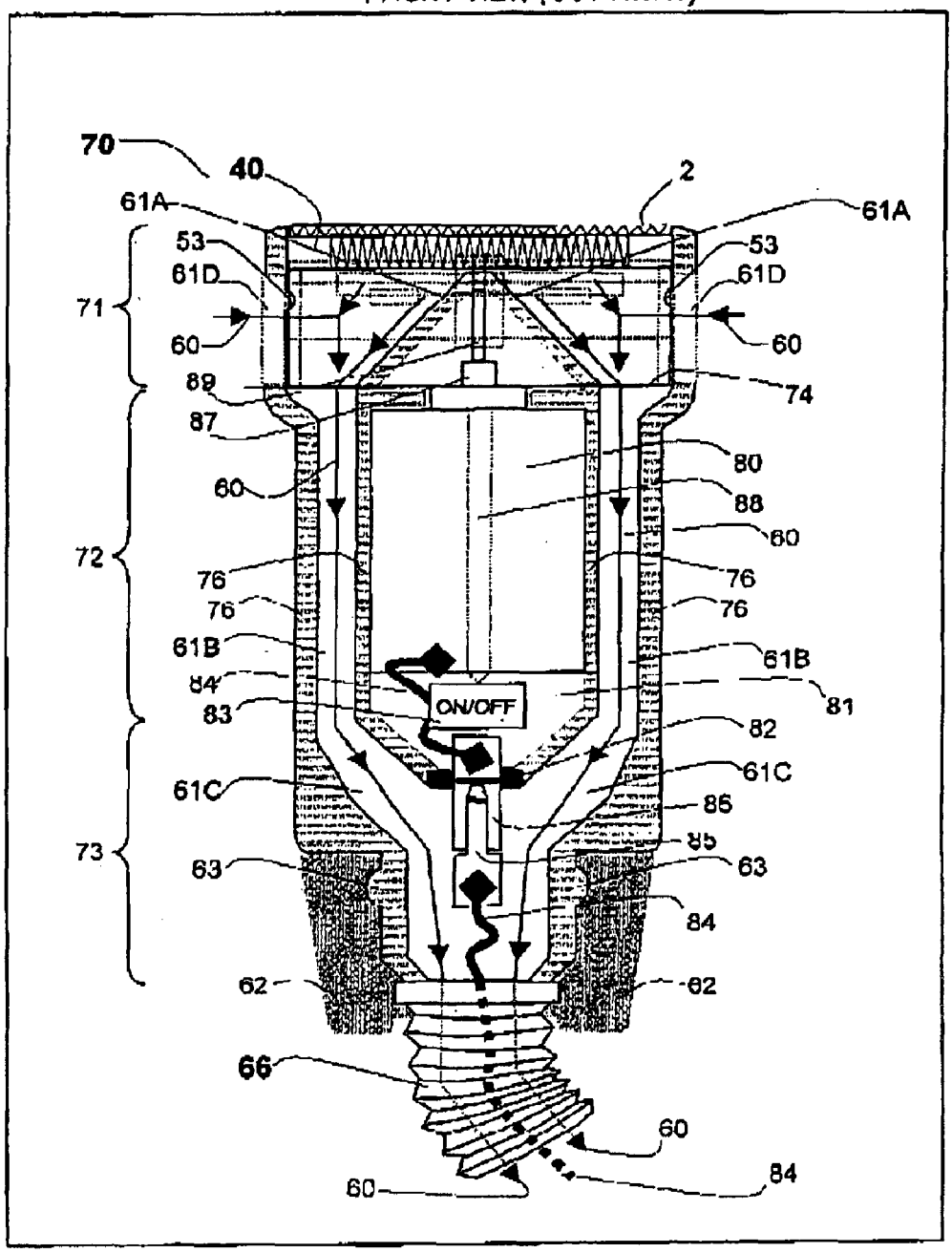

*Clipper Design*
FIGURE 31 CLIPPER & BLADE ASSEMBLY:
*SIDE VIEW (COMPONENTRY CUT-AWAY)*
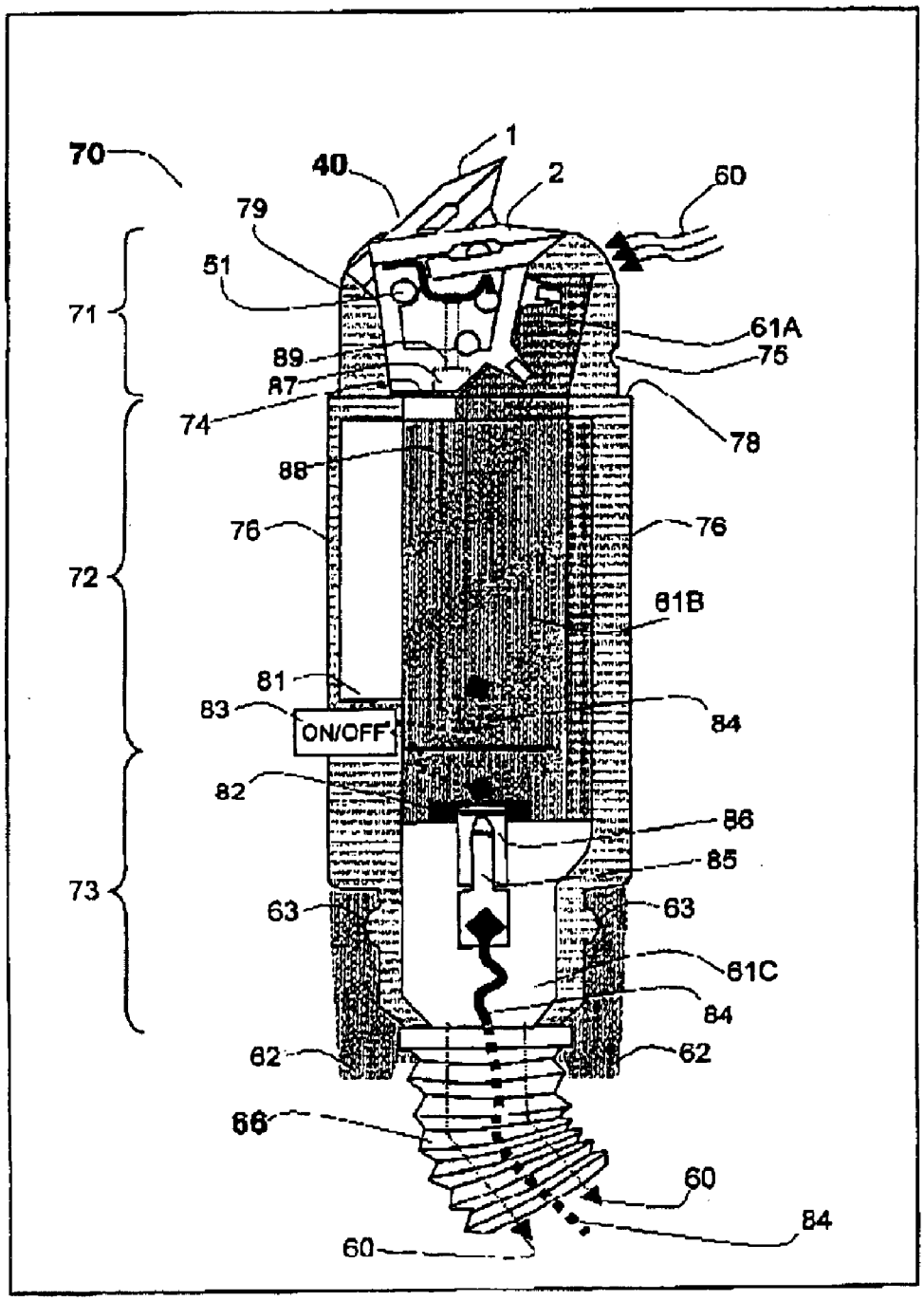

PIVOTABLE BLADE HAIR CLIPPER AND SUCTION COLLECTION SYSTEM

This application claims the benefit of Provisional Application No: 60/360,769, filed Mar. 1, 2002.

BACKGROUND OF THE INVENTION:

The present invention relates to electric hair clippers, trimmers and shavers, and specifically to such devices having blade assemblies that are pivotable and in some cases detachable relative to the handle portion.

Presently there are three methods used to cut human head hair or body hair: the manual razor, the electric clipper, and the electric clipper combined with additional attachments such as a household vacuum.

A major advantage of the manual razor is that it provides a simple, skin close hair cut. Inherent in its simplicity, however, are the disadvantages or being unable to accurately and consistently gauge hair cutting lengths other than skin-close, of the opportunity to nick one's skin with such a razor, and that any such hair trimming is achieved with no opportunity to perform the task neatly and without the need for clean up afterward.

Conventional electric hair clipper systems include two main components: a combined handle and drive system, and a removable or adjustable hair length gauge that functions to comb the hair toward a set of reciprocating blades. The blade assembly typically includes a fixed blade and a moving blade coaxially reciprocating relative to the fixed blade. In addition to removing hair on the human head, conventional electric hair clippers are often used to remove unwanted or unhygienic body hair. A major disadvantage of conventional hair trimming methods, especially concerning the removal of body hair, is that electric clippers are not designed to accommodate the users anatomy beyond certain parts of the head such as scalp, beard and neck. Without skin protection, such as a safety guard, and without a design that allows a user to access certain hard-to-reach or sensitive body surfaces such as the back, conventional hair clippers can be awkward and inaccurate, even injurious during any such body hair application.

Electric hair clippers are occasionally used with vacuum attachment means to evacuate clipped hair debris. While the obvious advantage of neatness is addressed using this clipper method there remain some equally obvious disadvantages. More specifically, no matter whether the operator intends to use such a clipper system to cut head hair or to cut body hair the shape of the hair clipper with its attachments is unwieldy and does not accommodate certain hard-to-reach or sensitive body surfaces for hygienic clipping. Also the hair clipper attachments are typically intended for use with a household vacuum producing a very definite and very loud noise in the work area while in operation, and not every household that could benefit from a home hair clipper set possesses a type of vacuum appropriate for this clipper method.

One disadvantage of these conventional hair clipper units having attachments that serve as a comb, or guide, or length gauge is the difficulty in efficiently placing or aligning the typically large, attachments on the skin surface of certain body areas for cutting or trimming of the hair there at predictable and consistent lengths. When utilizing conventional electric hair clippers, the operator accomplishes the hair cutting by employing a "combing" motion typically requiring a lengthy comb attachment that painfully scrapes or scratches sensitive body areas and also prevents the clipper from performing the actual hair cutting when such a method is applied in tight or close body areas such as the groin or underarm, or in other words, where there is not sufficient work area to accomplish the combing motion. The combs are typically shaped of angular plastic that catches the skin and causes scratching or scraping of the skin as well as uneven cutting of the hair and can impede the user's ability to positively control the blade position or cutting angle as the clipper is passed over the skin surface.

Another disadvantage of both manual razors and conventional hair clipper systems is that cut or clipped hair debris is allowed to fall back onto the skin surface or to fall into the work area requiring some type of additional work for hygienic removal of said hair debris. Furthermore, conventional hair trimming methods typically necessitate that the user acquire and organize multiple tools or tedious cleansing methods to accomplish the work from start to finish. For example, the need for vacuum attachments, a vacuum or broom, mirror aids, protective clothing such as towels or capes, and/or an array of hair debris collection or removal techniques including vacuuming, sweeping or bathing can produce a hair cutting or hair trimming experience that is frustrating, time consuming, cumbersome, or even injurious if one's skin is scratched, scraped or nicked by an attachment or by an unprotected blade.

Thus, an object of the present invention is to provide an improved hair clipper wherein hair clippings are immediately suctioned away through the clipper handle portion and this action requires no special parts or unwieldy attachments other than the personal size vacuum hair collection canister and suction hose distributed with and connected to the clipper unit.

Another object of the present invention is to provide an improved hair clipper wherein the blade assembly is easily pivotable into at least two cutting angles and provides the user with a multi use tool that either can be angled at approximately 45 degrees from perpendicular for ideally cutting hair from the head or can be angled at approximately 90 degrees from perpendicular for the ideal hygienic clipping of certain hard-to-reach or sensitive body surfaces.

Another object of the present invention is to provide an improved hair clipper wherein the difficult-to-reach area of the back is addressed such that the clipper is integrally designed to receive an extending attachment allowing the user to easily pass the clipper blades over the surface of the back to remove unwanted or unhygienic back hair.

Another object of the present invention is to provide an improved hair clipper wherein the attachments conventionally known as combs, guides or length gauges ("guard/gauges") are designed to address the at least dual function of the improved hair clipper such that guard/gauges intended for the cutting of head hair are similar, if only in that comb portion, to those of convention with respect to shape and function of the comb portion and allow the user to accurately comb hair into the path of suctioned airflow and into the cutting blades while set at their 45 degree angle within the handle portion of the clipper and thus achieve an anticipated cut hair length; and guard/gauges intended for the cutting of body hair are specially designed to fit within the approximate 1.5 inch depth of the clipper unit, and in certain cases are specially designed for use in a "rolling" motion as well as a combing motion such that when hair on a sensitive or angled portion of the body is to be trimmed, as would be the case in the bikini area, the user can gently "roll" the body hair into the stream of air being suctioned through the handle portion of the clipper unit and into the path of the cutting blades for accurate cut length and immediate, safe, comfortable and hygienic evacuation of hair debris from the skin surface and from the work area.

SUMMARY OF THE INVENTION

Accordingly, the above-listed objects are met or exceeded by the present invention pivotable blade hair clipper and suction collection system which has a clipper handle with an integrally formed vacuum suction channel for the hygienic evacuation of hair clippings into a personal size vacuum hair collection canister by way of a suction hose, and has a pivotable blade assembly that is detachable, and has as well a back-reach attachment for extending the clipper to cut hair on the back plus guard/gauges specially contoured for cutting or trimming hair on sensitive and difficult-to-reach body surfaces, as well as guard/gauges specially contoured for cutting or trimming hair on the head and neck.

More specifically, the present invention includes a clipper handle having a drive end and internal suction formations, plus a blade assembly that is pivotable relative to the handle portion of the clipper to achieve comfortable head hair cutting and trimming and comfortable body hair cutting and trimming and is detachable. Additionally, three types of guard/gauge are designed for use with the present invention: one type of guard/gauge utilizes a 45-degree angle of the pivotable blade assembly and is suitable for cutting or trimming head hair and subsequently suctioning away clipped hair debris by employing a conventional combing motion; another type of guard/gauge utilizes an 80-degree angle of the pivotable bade assembly and is suitable for cutting or trimming hair on body surfaces that are relatively flat such as the back or chest and subsequently suctioning away clipped hair debris by employing a conventional combing motion, and in the case of the back by also attaching the back-reach attachment; and another type of guard/gauge utilizes an 80-degree angle of the pivotable blade assembly and is suitable for cutting or trimming hair on body surfaces that are sensitive and/or difficult-to-reach such as the bikini area by employing an unconventional "rolling" motion, which rolling motion protects sensitive skin surfaces from scratching or scraping, and which rolling motion can be achieved in close body areas such as the groin or underarm.

In the present invention, the pivoting feature of the at least dual position blade assembly enhances an ergonomic clipper design and enables the operator to hold the clipper in a natural manner at all times whether cutting hair on the head and neck, or cutting hair on the chest or other body surface, or using the back-reach attachment to trim hair on the surface of the back, pivoting the blade assembly as previously described changes the position of the blade assembly's cutting edges relative to the clipper handle portion to either of 45 degrees for head hair cutting or 80 degrees for body hair cutting. The pivotable design of the blade assembly ensures that an ideal cutting angle with respect to ergonomics in the users hand is achieved for all cutting techniques. Thus, the present invention hair clipper is readily altered from a head hair trimming tool, to a body hair trimming tool, to a back hair trimming tool providing a comfortable, accurate, safe and clean hair trimming experience that applies to any surface of the body.

The present invention air suction channel ensures that clipped hair debris is immediately suctioned free of the skin surface and the work area and deposited cleanly into the vacuum hair collection canister. The newly shaped guard/gauges ensure that a comfortable and accurate cut can be achieved by employing a "rolling" motion of the clipper unit in a space the approximate width of the clipper unit itself rather than utilizing a longer combing motion as is the convention, yet more conventionally shaped guard/gauges can also be used to "comb" the hair into the blades when cutting or trimming hair on the head or hair on a relatively flat surface of the body such as the chest.

In the present invention, the "rolling" action of the guard/gauges, the design and shape of the dusting blades, the pivotable blade assembly and its centralized placement in the drive end of the clipper handle, the air suction channel integrally designed into the handle portion of the clipper unit and designed integrally with the blade assembly to aerodynamically evacuate clipped hair debris, and the suction hose and vacuum hair collection canister constitute improvements to existing art and/or unique combinations of known art that will enable the user to comfortably and cleanly achieve a desired hair cut length on both the head and the body.

In another embodiment, the present invention provides a hair clipper including a handle portion having a drive actuator member extending from the drive end to accommodate a blade assembly reciprocative about the drive end of the handle portion, plus an air suction channel integrally formed in the handle portion to aid in the evacuation of clipped hair debris toward a means of debris collection.

In a further embodiment, the present invention provides a hair clipper including a handle portion having a drive actuator member extending from the drive end, plus a blade assembly that is reciprocative about the drive end of the handle portion of the clipper and that is pivotable to at least two distinct cutting angels relative to the handle portion of the clipper, plus an air suction channel integrally formed in the handle portion of the clipper to aid in the evacuation of clipped hair debris.

In an alternative embodiment, the present invention provides a pair clipper including a handle portion having a drive actuator member extending from the drive end, plus a blade assembly reciprocative about the drive end of the handle portion of the clipper, plus an air suction channel integrally formed in the handle portion of the clipper to aid in the evacuation of clipped hair debris. Also included in the blade assembly is a cam follower integrally shaped to maintain contact with the drive actuator member at all times during operation and means by which the blade system can be pivoted to achieve at least two distinct cutting angles relative to the handle portion of the clipper.

In still another embodiment, the present invention provides a vacuum hair collection canister for use with a hair clipper, the clipper including a butt portion suitable for attachment by way of a suction hose to the vacuum hair collection canister and the vacuum hair collection canister including storage space for a suction hose, clipper unit, built-in mirror, and further attachments such as combs or guards or gauges or guard/gauges and a back-reach attachment. In this embodiment, the vacuum hair collection canister shall have filtration means suitable for collecting clipped hair debris, and the clipper shall have a handle portion having a drive actuator member extending from the drive end, plus an air suction channel, integrally formed in the handle portion to aid in the evacuation of clipped hair debris toward the hair collection canister, plus a blade assembly reciprocative about the drive end. Also included in the blade assembly is a cam follower integrally shaped to maintain contact with the drive actuator member at all times during operation and means by which the blade assembly can be pivoted to achieve at least two distinct cutting angles relative to the handle portion of the clipper for achieving maximum ergonomic user comfort during all types of operation.

BRIEF DESCRIPTION OF THE DRAWINGS

FIG. 1 is a preferred elevated perspective of the clipper handle and suction hose.

FIG. 2 is a preferred front cut-away of the clipper and blade assembly.

FIG. 3 is a preferred side componentry cut-away of the clipper and blade assembly.

FIG. 4 is an elevated perspective of the blade assembly.

FIG. 5 is an elevated perspective blow-up of the blade assembly.

FIG. 6 is an elevated perspective cut-away of the blade assembly.

FIG. 7 is a componentry side cut-away of blade assembly positions.

FIG. 8 is a componentry side cut-away of the blade assembly.

FIG. 9 is a componentry side cut-sway of blade assembly pivot action.

FIG. 12 is a side and bottom cut-away of blade and spring attachment method.

FIG. 13 is a side componentry cut-away of the suction hose connections.

FIG. 14 is a side componentry cut-away of the vacuum hair collection canister.

FIG. 15 is a side overlay of the "rolling" design guard/gauge.

FIG. 16 is an elevated perspective of the skin guard.

FIG. 17 is an elevated perspective of the "rolling" design guard/gauge.

FIG. 18 is a blow-up of the "rolling" design guard/gauge.

FIG. 19 is a side overlay of the "body" design guard/gauge.

FIG. 20 is a side overlay of the skin guard.

FIG. 21 is an elevated perspective of the "body" design guard/gauge.

FIG. 22 is a blow-up of the "body" design guard/gauge.

FIG. 23 is a side overlay of the "hair" design guard/gauge.

FIG. 24 is a blow-up of the skin guard.

FIG. 25 is an elevated perspective of the "hair" design guard/gauge

FIG. 27 is an elevated perspective of the back-reach attachment collar.

FIG. 27A is a side view of the back-reach collar and rod methods.

FIG. 28 is a schematic of the pivotable blade hair clipper and suction collection system.

FIG. 29 is an elevated perspective of the clipper handle and suction hose.

FIG. 30 is a front cut-away of the clipper and blade assembly.

FIG. 31 is a side componentry cut away or the clipper and blade assembly.

DETAILED DESCRIPTION OF THE PREFERRED EMBODIMENT

GENERAL

Figure 26:
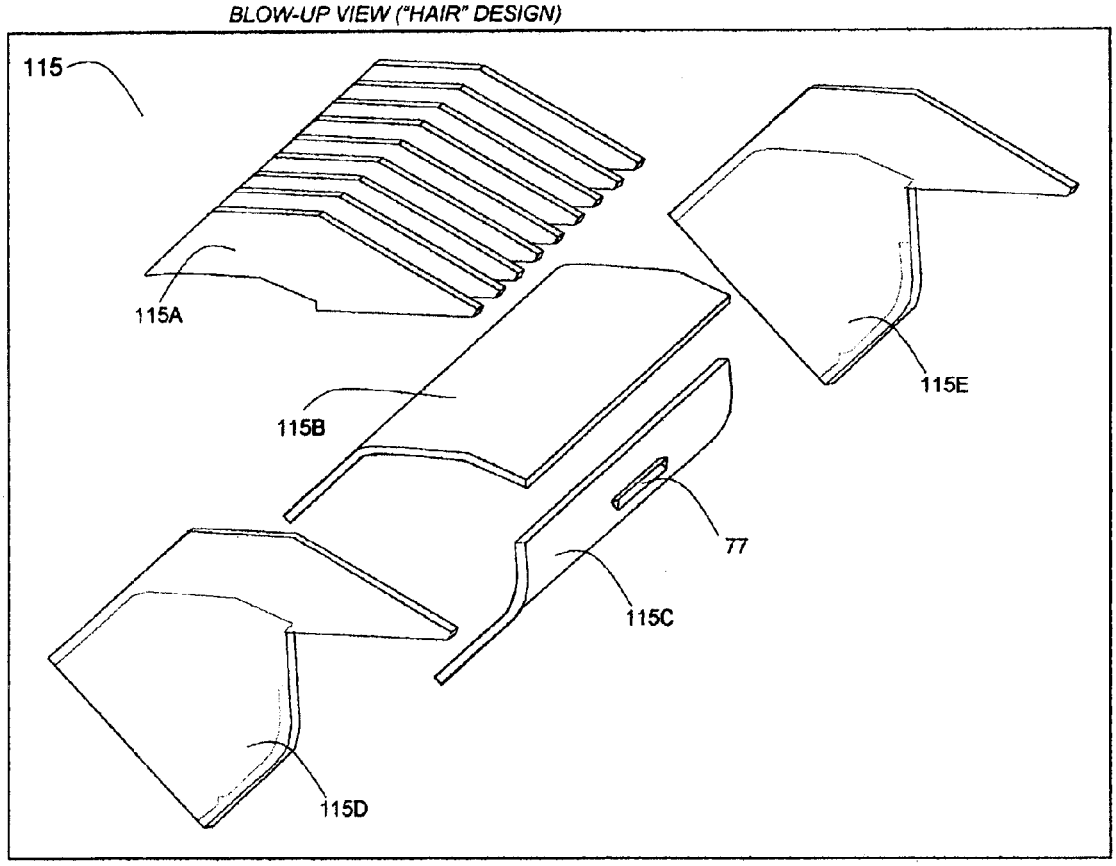
FIG. 26 is a blow-up of the "hair" design guard/gauge.

Referring now to FIG. 28, the present invention is a pivotable blade hair clipper and suction collection system. In its preferred embodiment the present invention comprises substantive parts combined to achieve safe and comfortable clipping of head hair and body hair and the evacuation of subsequent clipped hair debris through its clipper handle, then through its suction hose, and into its vacuum hair collection canister. More specifically, a pivotable blade hair clipper and suction collection system of the type suitable for use in the present invention is generally designated 11 and comprises: a pivotable blade assembly generally designated 40; a clipper handle portion generally designated 70 having a clipper motor 80 with blade driving means 89; four distinct suction formations 61A, 61B, 61C, 61D; a flexible suction hose 66; a vacuum hair collection means generally designated 90; and accessories specific to the anticipated functionality of the present invention that include combs, blade guards, or hair length gauges ("guard/gauges") 113, 114, 115 and a skin guard SG1, plus a back-reach attachment 112 and built-in mirror 98.

Referring now to FIGS. 3 and 28, in the present invention the clipper handle 70 having a clipper motor 80 drives a pivotable blade assembly 40 that is designed to channel suctioned air 60 across its cutting portion and into the suction formations 61A, 61B, 61C preferably integrally molded in the clipper handle portion 70 whether the pivotable blade assembly 40 is parked in its first position 1 or parked in its second position 2 (best seen in FIG. 3). The clipper unit 70 comprises a handle drive end portion 71, a handle motor house portion 72, a handle butt portion 73, a motor 80 and switch 83, plus four district suction formations 61A, 61B, 61C, 61D that are integrally designed for safely passing suctioned air 60 and clipped hair debris through the clipper unit 70 and into the suction hose 66 for evacuation into the vacuum hair collection canister 90.

TERMS AND ORIENTATIONS

Referring now to FIGS. 1, 2 and 3, in the present invention pivotable blade hair clipper and suction collection system the handle drive end portion 71 is formed preferably of durable, impact-resistant molded polymeric or plastic material as is known in the art creating a cavity ("drive end cavity") into which the pivotable blade assembly 40 is secured by means described in the section designated "Pivotable Blade Assembly." It is known, therefore, that subsequent use of the term "drive end cavity" references the preferably integrally molded cavity that exists in the preferred design of the handle drive end portion 71 and into which the pivotable blade assembly 40 is secured.

Referring now to FIGS. 1 and 4 concerning the terms "anterior," "posterior," "left lateral," and "right lateral," it is known that relationally the anterior of the clipper 70 corresponds to the anterior of the drive end portion 71, which corresponds to the anterior wall of the drive end cavity, which corresponds to the anterior of the blade assembly 40, etc. Therefore, it is known that the terms "posterior," "left lateral," and "right lateral" also have patterns of relative correspondence as in the pattern described for the term "anterior" above. Furthermore, in the present invention, it is known that the term "face" describes the most exterior surface of the part referenced. Therefore, in the present invention it is known that the exterior of the clipper 70, including the handle drive end portion 71, comprises four faces: the anterior face, the posterior face, the left lateral face, and the right lateral face, and it is known that subsequent use of each of these terms assumes a frontal orientation of the clipper handle 70.

Referring now to FIGS. 1 and 3 in the present invention it is also known that the terms "apex" and "base" relate to or orientation of the clipper 70 and its associated components that is vertical as demonstrated in FIG. 1. It is also known that a view of the "interior" of the drive end cavity assumes a frontal orientation of the clipper handle 70, and that subsequent description of the pivotable blade assembly 40 when described in relationship with the drive end cavity assumes a frontal orientation of the pivotable blade assembly 40 and a correspondingly frontal orientation of the clipper handle 70, or of the handle drive end portion 71.

MAIN SUCTION FORMATION

Referring now to FIGS. 1, 2, 3, and 20 in the present invention pivotable blade hair clipper and suction collection system, preferably molded integrally throughout the clipper handle 70 is a system of hollow channel for immediately suctioning away hair clippings from the cutting portion of the blade assembly 40 and fluidly through the clipper handle 70. Designated the "main suction formation," this hollow channel is comprised of four integral suction formations 61A, 61B, 61C, 61D. Concerning the volume of suctioned air 80, it shall be understood by those skilled in the art that a vacuum collection means of the type suitable for the present invention will have a specific air intake volume ("optimum intake") when operating under optimum power conditions, said optimum intake being dependent on the size of the vacuum motor 100 and other variables including the fan blade driven by said motor, as well as the inner diameter of the suction hose 66 and the intake capacity of the main suction formation 61A, 61B, 61C, 61D formed in the clipper handle 70.

Referring now to FIGS, 2, 3 and 28, the function of the main suction formation 61A, 61B, 61C, 61D is threefold in that firstly, it takes into the clipper handle 70 and passes around the motor house 81 a volume of suctioned air 60 having in it clipped hair debris, and secondly the preferred embodiment having a formation suitable for suction hose connection at the handle butt portion 73 passes said air and said hair debris into the suction hose 66 connected to the vacuum hair collection canister 90, and thirdly a user safety precaution preferably is molded integrally into the clipper handle drive end 71 in the form of bilateral safety venting 61D. Each component of the main suction formation 61A, 61B, 61C, 61D substantially contributes to provide suctioned airflow 60, and each component, especially the bilateral safety venting 61D and the second suction formation 61B, also factors in providing a safety precaution 61D sufficient in design to prevent unwanted suctioning of the skin into the cutting portion of the blades while said blades possibly are in operation without the guard/gauge attachment 113, 114, 115 or skin guard SG1 (FIG. 2B).

Referring still to FIGS. 2, 3 and 28 concerning the mechanics of the suction formations in the preferred embodiment of the present invention, the first suction formation 61A begins and is divided within the handle drive end 71 just beneath the bottom blade of the pivotable blade assembly 40 when parked in its second position 2 (beat seen in FIG. 3). Said formation defers at the clipper handle motor house portion 72 into bilateral conduits designated the second suction formation 61B and which serve to pass the volume of suctioned air 60 around the motor housing, preferably dividing said volume equally and preferably not being formed at any place to constrict said volume. Said second formation defers to a formation suitable for suction hose connection 61C in the area of the handle butt portion, which portion has attached to it a suction hose 66 for evacuation of clipped hair debris into a vacuum hair collection canister 90.

Referring now to FIGS. 2 and 28 more specifically, the suction hose 66 is preferably highly flexible having an inner volume sufficiently large and sufficiently formed to accommodate at least optimum intake. In the preferred embodiment the formation suitable for suction hose connection 61C has sufficiently large inner volume and is sufficiently formed to accommodate at least optimum intake. Also preferable is that the second suction formation 61B has sufficiently large inner volume at each of and is sufficiently formed at each of its bilateral components to accommodate at least half the optimum intake. Additionally, the first suction formation 61A preferably has sufficiently large inner volume and is sufficiently formed at each of its laterally deferred edges to accommodate at least half the optimum intake. Furthermore, the bilateral safety venting 61D preferably is sufficiently large and formed at its bilateral components to draw through each of them at least half the optimum intake. Finally, the main suction formation 61A, 61B, 61C, 61D as a whole preferably has sufficiently large inner volume and is sufficiently formed to accommodate optimum intake.

Referring now to FIGS. 1, 2, 3 and 28 with respect to appearance and location of suction formations described above, at the handle drive end 71 are the bilateral safety venting 61D and the first suction formation 61A. In the handle motor house portion 74 is the bilaterally situated second suction formation 61B, and in the handle butt portion 73 is the formation suitable to suction hose connection 61C. More specifically, each of said formations is unique in its appearance and in its function, and each comprises and is integral to the overall function of the main suction formation discussed above, yet each is considered separately within the clipper handle 70 only for purposes of detailed description.

Referring still to FIGS. 1, 2, 3 and 28 and concerning the bilateral safety venting 61D sad the first suction formation 61A, said safety venting preferably is comprised of bilaterally situated polygon shaped holes formed integrally in the lateral walls of the handle drive end portion 71 of the clipper 70. Their shape, positioning and function are described in detail in the section designated "Handle Drive End Safety Venting." As for this first suction formation 61A, its shape, positioning and function are described in detail in the section designated "Handle Drive End Anterior Wall." Concerning the second suction formation 61B its shape, positioning and function are described in detail in the section designated "Handle Motor House Portion." As for the formation suitable for suction hose connection 61C its shape, positioning and function are described in detail in the section designated "Handle Butt Portion."

PIVOTABLE BLADE ASSEMBLY

GENERAL

Referring now to FIGS. 2, 3 and 4 in the preferred embodiment of the present invention pivotable blade hair clipper and suction collection system, the pivotable blade assembly 40 is stationed in the handle drive end 71 of the clipper 70 and preferably is secured there by means of a pivot axle male portion 42 and a pivot axle female portion 41 comprising an axle around which the blade assembly is pivotable. More specifically, the pivot axle preferably is an elongate screw 42 and a threaded elongate barrel 41 each inserted into a lateral face of the handle drive end 71 by way of the pivot axle hole 51 preferably formed integrally thereon, thus semi-permanently securing the blade assembly 40 into the clipper handle 70. Also, in the preferred embodiment of the present invention, pivot axle componentry is configured to a one-eighth inch diameter axle.

PIVOTABLE MOTION

Referring still to FIGS. 2, 3 and 4, the blade assembly 40 has a pivotable motion about the pivot axle 41, 42 and preferably has dimensions tightly accommodated by the drive end cavity into which it is secured. More specifically, it is known that the preferred 35-degree pivotable motion of said blade assembly about its pivot axle 41, 42 has as a paramount component precise placement of the pivot axle hole 51, which in its entirely is comprised of two holes located bilaterally in the handle drive end 71 and two holes located bilaterally in the housing 50 of the blade assembly 40 for a total of preferably four corresponding and precisely positioned holes. Furthermore, the blade assembly 40 is secured by similar means into each of its two pivot positions 1, 2, said means being both the pivot axle hole 51 and safety formations 53 all preferably formed integrally in the handle drive end portion 71, and the corresponding pivot axle hole 51 and dual position formations 52 all preferably formed integrally in the blade housing 50, and the pivot axle 41, 42. In an alternative embodiment, the pivot axle 41, 42 is contemplated as molded plastic integrally a part of the housing 50 of the blade assembly 40.

Referring now b FIGS. 3, 4 and 28, the present invention hair clipper 70 component is readily altered from a head hair trimming tool, to a body hair trimming tool, to a back hair trimming tool by pressing inward both pivot tabs 55 of the blade assembly 40 then applying pressure upward or downward, thus disengaging said blade assembly out of one position into the newly chosen position, and then releasing said pivot tabs. The dual position formation 52 formed integrally in the housing 50 of the blade assembly 40 reseals itself onto a corresponding safety formation 53 formed integrally in the handle drive end 71 of the clipper handle 70 upon release of the pivot tabs 55 of the newly chosen position 1, 2. The hair clipper 70 is further altered specifically to a back hair trimming tool by choosing the second blade position 2 in the manner described above and attaching the back-reach attachment 112 to the clipper 70.

Referring now to FIGS. 1, 3 and 5, the blade assembly 40 has dimensions and contouring that are tightly accommodated by the drive end cavity into which it seats, said contouring being described in detail in the sections discussing the handle drive end 71. In the preferred embodiment the pivotable blade assembly 40 includes a fixed blade 43 and reciprocating blade 44, a pivot axle 41, 42, housing 50, a blade actuator having a cam follower 47, spring means 40 and fastening means 45, each of said components being integral to the assembly of the pivotable blade assembly 40. The fastening meant 45 is also contemplated as clips, rivets, tabs or other fastening means that are preferably semi-permanent.

Referring now to FIGS. 1, 2, and 5, contemplated also for use with the present invention in another embodiment is a safety release means 54 composed of a spring-action rod and barrel combination suitable for attachment to the handle drive end 71 at either of or both of the lateral walls. Said safety release means is contemplated to replace either of or both of the laterally situated safety formations 53, thus providing the user with additional security against unwanted slippage upward or downward of the blade assembly 40 during operation. Such contemplated embodiment of the present invention preferably necessitates that the user disengage the safety release means 54 by pulling said safety release means out of the dual position formation 62 formed integrally into the housing 50 of the blade assembly, and thus out of the path of said housing allowing said blade assembly to pivot in the manner described above.

BLADES

Referring now to FIGS. 5 and 12 and describing the preferred embodiment blades, each blade 43, 44 appears rectangular in shape with rounded corners at the posterior non-cutting portion and a plurality of teeth at the anterior cutting portion. The plurality of teeth 44*a* along the anterior edge of the reciprocating blade 44 preferably is greater than that 43*o* along the anterior edge of the fixed blade 43. The teeth 43*a* of said fixed blade have a greater rake angle than those 44*e* of their counterpart reciprocating blade 44. Preferably, the teeth 43*a* on the fixed blade 43 are spaced more widely than the teeth 44*e* on the reciprocating blade 44. Further, the differences in tooth shape and spacing generally provide a more efficient cutting action than when identical tooth patterns are used for both blades. Additionally, the teeth 43*d* at each lateral edge of the fixed blade 43 are rounded, wider and preferably smooth such that irritation scratching or nicking of the akin surface is nullified. The number of teeth and the actual teeth configuration employed will depend on the application of the product and manufacturing requirements.

Referring now to FIGS. 5 and 8, each blade 43, 44 is formed such that there exists a substantially flat sliding surface at the anterior bottom and the posterior bottom of each blade and a slight concavity 43*b*, 44*b* there between. Each blade is formed such that on inverting them and securing them one against the other their flat surfaces slidingly abut and their concavities 43*b*, 44*b* form an appreciable space there between.

Referring now to FIG. 8, the reciprocating blade 44 is slightly offset laterally toward the posterior edge of the fixed blade 43 (FIG. 8A). This relative position of the blades is intended to prevent the user from nicking and/or cutting the skin on the body surface being attended and is a relationship between reciprocative blade parts that is well known in the art. The reciprocating blade 44 is assembled upon the blade drive actuator 47 so that the cutting edge extends out the open portion of the anterior of the blade housing 60 (FIG. 8B), and is inverted relative to the fixed blade 43 to that apace 43*b*, 44*b* is formed between the two blades. However, the opposing toothed edges will be in sliding contact with each other. The blades 43, 44 are only partially enclosed by the housing 50 and project from the open side to engage hair to be clipped (FIG. 8D).

Referring now to FIGS. 5 and 12, the fixed blade 43 has dimensions such that it is appreciably larger than the reciprocating blade 44. Bilaterally along the posterior edge of the fixed blade 43 is a threaded hole 43*c* the function of which is to receive a correspondingly threaded fastener 45 intended to secure together the housing 5*o* and inner componentry 43–50 of to blade assembly 40. Concerning the reciprocating blade 44, said blade has dimensions that relative to the fixed blade 43 are appreciably smaller than would be the convention in the art. Centrally formed on the reciprocating blade 44 is a guide slot 44*c* corresponding to the guide boss 47*o* formed on the blade actuator 47. Said slot has dimensions that tightly accommodate said guide boss to encourage only sliding movement of and prevent unwanted play in the blades 43, 44 during operation.

HOUSED COMPONENTRY

Referring now is FIGS. 3, 4, 6 and 12, the pivotable blade assembly 40 receives its pivotable motion by way of the pivot axle 41, 42 that secures it. At least two forms of safety, and a contemplated third form, are provided toward prevention of unwanted slippage in said pivotable motion by way of the tightly accommodating pivot axle holes 51, the dual position formations 52, and the contemplated safety release means 54. Suctioned air 60 is channeled past the blade boating 50 by its inherent contouring (best seen in FIG. 4). Within said blade housing is the blade spring means 48 and the blade actuator 47 having a cam follower 47*b*. Also extending into said blade housing is the drive actuator member 89 (FIG. 3) that provides the reciprocal motion to the blades. The fixed blade 43 secures stop the blade housing having preferably two screws 45 extending through its posterior edge into the spring means 48 and housing 50 below. Said spring means supports the blade actuator 47 by way of tightly fitting into the notches 47*c* (best seen in FIG. 12) integrally formed on the bottom or underside of its rectangular extension, which blade actuator 47 supports and guides the reciprocating blade 44 by way of the guide boss 47*a* and integrally formed guide slot 44*c*into which it fits. Said reciprocating blade is further supported and held tightly against the fixed blade 43 by way of the spring means 46 applying biasing force there against.

Referring now to FIGS. 5 and 12, the blade actuator 47 is comprised of several integrally formed components but preferably is a single plastic formation. Said bade actuator has along its top a preferably rectangular extension that is formed substantially flat to tightly fit against the reciprocating blade 44 when said blade is inverted atop it for assembly, and that is long enough to accommodate the reciprocal stroke of and to support said reciprocating blade. Atop said extension is found the centrally located and preferably elongate guide boss 47*a* suitable for stabilizing the sliding actuation of the reciprocating blade 44 by way of a corresponding blade guide slot 44*o* formed centrally in said reciprocating blade to tightly accommodate said guide boss.

Referring still to FIGS. 5 and 12, the above described rectangular extension of the blade actuator 47 has centrally formed on its bottom bilaterally extended notches 47*c* (best seen in FIG. 12) or spring guides to accommodate slidingly the spring means 46 delivering the biasing force to the cutting blades. Said notches extend laterally in either direction sufficiently to accommodate the reciprocal stroke of said reciprocating blade while traveling along the spring means 46, said spring means being of a type known in the art to apply a biasing force against the cutting blades and being bilaterally installed and made stationary by screws 45 or other preferably semi-permanent attachment means. Said spring means holds the reciprocating blade 44 tightly against the fixed blade 43 to perform the cutting action. Said spring means also is contoured to fit beneath the reciprocating blade 44 and above the housing 50 while extending around the pivot axle 41, 42 such the no appreciable contact or biasing forces exist between said spring means and said pivot axle that would cause either to seize upon engagement into a new pivot position. The guide boss 47*a* slides reciprocally between the spring means 48, and the integrally formed notches 47*c* of said blade actuator travel along the top of the integrally shaped and stationary spring means 46.

Referring now to FIGS. 3, 5, 8, 9 and 12, also located on the bottom of the rectangular extension of the blade actuator 47 is a cam follower 47*b* (FIG. 5) formed to accommodate the actuating motion of the drive actuator member 89 (FIG. 3). The cam follower 47*b* (FIG. 5) is shaped and formed to maintain substantial contact with the drive actuator member 89 (FIG. 3) during the arc of pivot 3 (FIG. 8), whether the pivotable blade assembly is parked in its first position 1 or in its second position 2 (FIG. 3). Said cam follower is slotted in its interior in a manner known in the art to produce only lateral movement of the blade such that on actuation by the drive actuating member 89 of the motor 80 reciprocal motion transfers to the reciprocating blade 44. Said cam follower transfers reciprocative motion only slidingly to the reciprocating blade 44 by way of the guide boss 47*a* (FIG. 5) and spring notches 47*c* (FIG. 12). Said motion coupled with biasing force placed against the blades by the spring means 45 causes the teeth to cut hair. The blade actuator 47 (FIG. 8B) is shaped to fit within the interior of the blade housing 50 and also shaped at its posterior edge to loosely accommodate the pivot axle 41, 42 (FIG. 8D). Said cam follower slides reciprocally at the anterior, central portion of the housing 50 and necessarily must not be fitted tightly against said housing thus preventing unwanted friction or possibly diminished performance of the blade assembly 40.

HOUSING

Referring now to FIG. 5 concerning the blade housing 50, it is known that in the present invention said housing serves to guide suctioned air into the clipper handle and therefore preferably has solidly formed faces at its anterior, posterior and lateral portions. Said housing has an opening at its top face that includes a portion of the anterior face 50*e* suitably formed to accommodate reciprocal motion of the reciprocating blade 44, is open at the bottom, and is hollow in the interior to accommodate internally housed componentry. Installation of said componentry is accomplished by way of the openings at the top and bottom faces of the housing 50.

Referring now to FIGS. 1 and 5, the blade housing 50 preferably is formed of metal or plastic capable of being threaded, or capable of receiving a threaded part or lock washer means to aid in assembly, bilaterally at its posterior top portion 50*f*. Said housing has at its posterior top portion 50*f* an integrally formed rectangular portion having preferably threaded holes that serve to receive correspondingly threaded screws 45 upon assembly and serve to support and semi-permanently secure the fixed blade and spring means. Said housing has at its anterior a rectangular recession 50*e* of the anterior wall such that the motion of the reciprocating blade 44 is accommodated there. Said housing has formed in its lateral faces pivot axle holes 51 corresponding to the positions of the pivot axle holes 51 formed in the lateral faces of the handle drive end portion 71 (FIG. 1), and said housing also has formed in its lateral faces a dual position formation 52 corresponding to the safety formation 63 formed in the drive end cavity of the handle drive end portion 71 (FIG. 1).

Referring still to FIGS. 1 and 5, said housing preferably also has at each of its most lateral edges of the anterior face a pivot tab 66. Said tabs extend outward through the bilateral safety venting 61D to flush with an lateral faces of the handle drive end 71 upon installation of the blade assembly 40. Said tabs are intended for engaging and disengaging from safety formations 53 (FIG. 1) at each of the parked positions of the blade assembly 40 by way of applied finger pressure as described earlier. A significant advantage of the construction of the pivot tabs 65 and the cam follower 47*b* is that the operator may readily pivot the blade assembly 40 upon the handle drive end portion 11 by merely depressing the pivot tabs 55 and exerting a slight pushing force axially directed upward or downward relative to the blade assembly. There is no special alignment or manipulation required to achieve proper subsequent engagement of the blade assembly upon the handle as it readily reseats itself at the newly chosen pivot angle, and engagement of the cam follower 47*b* upon the drive member 89 is never comprised due to said cam follower's continuous contact with said drive member during all pivot angles. Also located at the lateral edges of said anterior face preferably is vertical slotting 50*d* allowing the press tabs 55 to more easily depress and disengage the housing 50 from the safety formations 53 for pivot action.

The slotting 50*d* has dimensions sufficient to positively affect the intentions of the press tab 65 but the not negatively affect the aerodynamic intention of the housing's anterior face.

GUARD/GAUGES

Referring now to FIGS. 3 and 17, upon shifting the blade assembly 40 into either of two positions as described previously, the user attaches an appropriate guard/gauge to achieve a predetermined cut length. Preferably all such gauge/gauges are made of plastic material as is conventional in the art with special attention being focused on the potential for rough or angular plastic edges as the discomfort they can cause against the skin surface is undesirable. Preferably all such guard/gauges have formed integrally on their anterior face a male counterpart 77 to the guard/gauge securing means 73 located on the anterior face of the clipper handle 70, which securing means are both described in the section designated "Handle Drive End Guard/Gauge Securing Means."

Referring now to FIGS. 15, 17, 18 and 28, the guard/gauge 113 specific in cutting the body hair in tight, angular, or niche-like spaces as would be the case in the bikini area, is engineered to fit onto the blade assembly 40 while parked in its second position 2 (FIG. 15) and is shaped to "roll" within a space equivalent to the depth (preferably 1.5 inches) of the clipper 70, plus is engineered to block the flow of suctioned air 60 into bilateral safety venting 61D described below in the section "Handle Drive End Safety, Venting." The benefit of the guard/gauge 113 is the "rolling" motion that allows for cutting and trimming of body hair in areas of the body previously difficult to attend with conventional clipper and guard/gauge trimming systems, as would be the case in the bikini area, plus simultaneous evacuation of clipped hair debris from the skin surface and from the work area into the vacuum hair collection canister 90. A blow-up view (FIG. 18) of said guard/gauge demonstrates the individual componentry 113*a*, 113*b*, 113*c*, 113*d* 113*e*, 77 of the preferred embodiment single molded plastic part dimensioned to a half-inch hair cutting length.

Referring now to FIGS. 19, 21, 22 and 28, the guard/gauge 114 specific to cutting the body hair on relatively flat surfaces, as would be the case on the chest or abdomen, is engineered to fit onto the blade assembly 40 while parked in its second position 2 (FIG. 19) and is shaped to "comb" the body surface in a conventional manner, plus is engineered to block the flow of suctioned air 60 into the bilateral safety venting 61D. The benefit of the guard/gauge 114 is a predetermined cut length utilizing a conventional combing motion when drawn across a relatively flat surface of the body, such as the chest or abdomen, at an angle most notably anticipated for the users self, plus simultaneous evacuation of clipped hair debris from the skin surface and from the work area into the vacuum hair collection canister 90. A blow-up view (FIG. 22) of said guard/gauge demonstrates the individual componentry 114*a*, 114*b*, 114*c*, 114*d*, 114*e*, 77 of the preferred embodiment single, molded plastic part dimensioned to a half-inch hair cutting length.

Referring now to FIGS. 23, 25, 26 and 28, the guard/gauge 115 specific to cutting the head hair is engineered to fit onto the blade assembly 40 while parked in its first position 1 (FIG. 23) and is elongate and comb shaped to reflect a standard wall known in the art, plus is engineered to block the flow of suctioned air into the bilateral safety venting 61D. The benefit of the guard/gauge 115 is a predetermined cut length utilizing conventional motions for cutting hair on the head while simultaneously evacuating clipped hair debris from the scalp surface and from the work area into the vacuum hair collection canister 90. A blow-up view (FIG. 25) of said guard/gauge demonstrates the individual componentry 115*a*, 115*b*, 115*c*, 115*d*, 115*e*, 77 of the preferred embodiment single, molded plastic part dimensioned to a half-inch hair cutting length.

SKIN GUARD

Referring now to FIGS. 16, 20, 24 and 28, the present invention attachment designated the skin guard SG1 is similar in material, function, and method of installation to the above described guard/gauges. The skin guard SG1, however, is designed to offer a skin-close cut of the hair plus prevent skin surface from coming into contact by suctioned force with the cutting portion of the blade assembly 40, while simultaneously evacuating clipped hair debris from the skin surface and from the work area into the vacuum hair collection canister 90.

Referring now to FIGS. 20 and 24, the preferred embodiment skin guard SG1 is demonstrated as being for use with the first position 1 pivotable blade position. As such, the exterior, lateral view of said skin guard (FIG. 20) provides a straight edge along its apex that is substantially flush with the fixed blade tooth rake angle. This straight edge along the posterior portion of the apex provides the user with a means of most efficient positioning of the blades relative to the skin surface during the skin-close cutting technique. Additionally, the straight edge along the anterior portion of the apex provides the user with a means for applying the cutting portion of the blade assembly 40 directly to the skin for applications such as trimming the hair line at the base of the neck. At the anterior portion of the skin guard SG1 is an opening sufficient in volume to accommodate optimum intake of the suctioned airflow 60. Also at its anterior is a guard/gauge securing means 77 of the type referred to above in the section designated "Guard/Gauges."

Referring still to FIGS. 20 and 24, an anticipated variation to the preferred embodiment skin guard SG1 is alteration to its design sufficient for accommodating the second position 2 (not shown) of the pivotable blade assembly 40 to similar end and intention of skin-close hair cutting technique. A blow-up view (FIG. 24) of the skin guard SG1 demonstrates the individual componentry SGa, SGb, SGc, SGd, 77 of the preferred embodiment single, molded plastic part dimensioned to a skin-close hair cutting length.

BACK-REACH ATTACHMENT

Referring now to FIGS. 27 and 27A, in the preferred embodiment present invention back-reach attachment 112, the collar 112*a* is demonstrated as having dimensions approximating a one-eighth-inch wall thickness. Horizontally centered on an apex and base of the collar 112*a* are two threaded portions 112*b*, 112*c* sufficient in dimension to receive correspondingly threaded rods 112*d*, 112*e* (FIG. 27A). Said rods preferably are sufficient in length such that they can be readily stored in the storage compartments of the invention, and such that they provide adequate reach when used to extend the clipper 70 to difficult-to-reach body areas such as the back.

Referring now to FIG. 27A, the preferred embodiment back-reach attachment rod and collar system is demonstrated as having eight distinct methods for attachment to the clipper 70. Formed on the collar 112*a* are the threaded insert portions 112*b*, 112*c* intended for rod attachment. By forming said insert portions axially, the collar can be installed on the clipper unit (FIG. 27AE) and then installed in the reverse direction (FIGS. 27AA, 27AB) to provide different positioning, and consequently different balance and leverage, in the user's hand. By varying the angle of the threaded inserts 112*b*, 112*c* on the top and the bottom of the collar 112*a*, said collar can be flipped (FIGS. 27AC, 27AD) on installation to provide still different balance and leverage.

Referring now to FIGS. 1 and 27, by forming integrally on the anterior and posterior faces of the clipper handle 70 and the corresponding interior of the collar 112*a* stop means 112*g*, 112*f* that preferably comprises correspondingly male and female nodules and concavities or holes, further variations of the previously described balance and leverage positions can be achieved. Said variations are achieved by adjusting the collar upward or downward along the body of the clipper handle 70 to engage each of the collar stop means nodules 112*g* provided along the clipper handle 70. The preferred embodiment back-reach attachment has two sets of corresponding stop means nodules 112*g* and stop means concavities or holes 112*f* plus two differently angled inserts 112*b*, 112*c* providing a total of sixteen distinct methods of attachment. Such variations in attachment method provide the invention with subtle variations to the back-reach attachment 112 as though sixteen differing suction attachments 112 were present for use. This adjustive intention provides the user with a greater degree of control and comfort in choosing which attachment method is most suitable for the given hair cutting task.

Referring now to FIG. 27A, the back-reach extension rods 112*d*, 112*e* are threaded in such a way that they combine to form an elongate rod having sufficient extension capability and having a preferably balled top and to aid in the prevention of slippage from the grasp during use of the attachment 112. Also said rods are sufficient in diameter and material to offer rigidity and stability within the collar inserts 112*b*, 112*c*, said inserts being also of sufficient diameter and material to offer rigidity and stability to said extension rods. The back-reach attachment 112 is installed on the clipper 70 (FIG. 27AE) in a specific order. First, the collar portion 112*a* is slidingly installed over the blade assembly 40 and onto the clipper handle 70, next the collar can be adjusted upward or downward on the clipper handle to change leverage, and finally both of the extender rods 112*d*, 112*e* can thread into the chosen collar insert 112*b*, 112*c*.

This preferred embodiment collar and rod method of attachment provides the back-reach attachment rod portion 112*d*, 112*e*, or "handle," with a secure means of installation that is rigid and stabilizing at the clipper 70 and also provides subtle variations to its angle of attachment for maximum user comfort and control. Such rigidity and stability offer the user ultimate control and optimum functionality of the back-reach attachment 112, especially when a light-weight and rigid material such as impact-resistant molded polymeric or plastic material known in the art is used in its construction. A contemplated different form of attachment of the rod portion 112*d*, 112*a* to the clipper 70 is a female receptacle integrally formed along the clipper handle 70 such that a correspondingly male insert at the tip of the rod portion 112*d*, 112*e* can be inserted directly into the clipper handle 70, again achieving a secure means of installation that is rigid and stabilizing at the clipper 70.

It remains preferable, however, to provide the user with varied angles of installation that will help to achieve an anticipated cut length in a safe, controlled and comfortable manner. For example, upon inserting the rod portion 112*d*, 112*e* directly into the clipper handle 70, angling the male rod tips and female inserts can provide subtle variations beneficial to the users preference and physical abilities, such as physical agility or dexterity. Simple designs will yield the best results, and one complication of the back-reach attachment 112 design will negatively impact rigidity, stability, comfort and control for the user. In achieving various design methods, the rod portion 112*d*, 112*e*, or "handle," of the back-reach attachment 112 should be shaped and angled to provide maximum utility, safety, comfort and control for its user. No matter the alterations to attachment means of the preferred embodiment present invention however, the scope of its substantive part back-reach attachment 112 remains unchanged, and that is to provide the user with a means for making extensible the clipper 70 and for safely reaching the clipper 70 to otherwise difficult-to-reach surfaces of the body.

Referring now to FIGS. 1, 27 and 27A, the benefit of the back-reach attachment 112 in the present invention is a great many variations in balance, leverage and extensible reach achieved with a minimum number of parts and complexity. With such an attachment 112, any body area or body surface is reachable while utilizing are clipper 70.

Additional embodiments of the back-reach attachment 112 are contemplated as any handle inserted directly into the clipper 70 but not into a collar 112*a* that is attached to the clipper 70. Generally, however, no matter the embodiment, the user will require a handle having a rigid and stabilizing means of installation at the clipper 70 in order to control the positioning of the blade assembly 40 against the body surface, and a handle that is sufficiently light-weight as to provide the user with comfort and control during its operation.

CLIPPER HANDLE

Referring now to FIGS. 2 and 3, an electric hair clipper of the type suitable for use in the present invention is generally designated 70 and includes a handle drive end portion 71, a handle motor house portion 72, a handle butt portion 73 opposite the drive end, and a motor 80 and switch 83 located there between. More specifically, the clipper handle 70 comprises: the handle drive end portion 71 including the first suction formation 61A and bilateral safety venting 51D; the handle motor house portion 72 including the second suction formation 61B, and including the motor housing 81 having a motor 80 and switch 83 located therein; and the handle butt portion 73 opposite the drive end including the formation suitable for suction hose connection 61C. The clipper handle 70, including its suction formations 61A, 61B, 61C, 61D and motor house 81, is formed preferably of durable, impact-resistant molded polymeric or plastic material as is known in the art. Also preferable is a blade assembly 40 (best seen in FIG. 3) that is pivotable to at least two positions 1, 2 for cutting hair and that is integrally designed to direct suctioned air 60 and clipped hair debris into the first suction formation 61A for subsequent evacuation through the clipper handle 70 by way of the suction hose 66.

HANDLE DRIVE END FLOOR

Referring now to FIGS. 1 and 9, the floor 74 of the drive end cavity is substantially flat and rectangular in shape, having a depth of approximately five sixteenths inch and a width of approximately two inches, and having a location in relation to the vertical axis of the clipper 70 that is slightly abaxial toward the posterior face of the clipper 70. Said floor is preferably conjoined or abutted along its four sides with relatively high walls thus creating the drive end cavity. Said walls are contoured specially to accommodate the full 35-degree arc of pivot 3 (FIG. 9) of the pivotable blade assembly 40 that is secured therein by means described in the section designated "Pivotable Blade Assembly."

Referring now to FIG. 1, the floor 74 comprises an opening DE1 at the center of its anterior side sufficient to accommodate the offset cam eccentric 87 and drive actuator member 89 that both preferably extend upward there through said floor, and that are both also slightly abaxial toward the posterior face of the clipper 70. More specifically, the relatively high and specially contoured interior walls of the drive end cavity are each preferably conjoined with their respective face of the clipper 70. In other words, the walls that create the specialty contoured drive end cavity extend toward their respective faces of the clipper 70 preferably as solidly molded material of the type previously described and therefore integrally comprise all of or part of said faces at the portion known as the handle drive end 71.

Referring now to FIGS. 1, 2 and 4, in contrast with the solidly molded material referenced in the previous paragraph are the bilateral edges of only that portion of the drive end cavity that is the first suction formation 61A. Necessarily, said formation does not conjoin at either of its left lateral or right lateral edges with either respective face of the clipper 70. Rather, said edges preferably conjoin with their respective sides of the clipper motor house 81 (FIG. 2) atop which the first suction formation 61A is located. This first suction formation 61A is a portion of the handle drive end 71 that is more specifically described below in the section designated "Handle Drive End Anterior Wall." Said portion creates a hollow 61A, 61B upon installation of the blade assembly 40, which is preferably integrally designed with said portion to fit tightly. Said hollow serves integrally to create the continuous main suction formation 61A 61B, 61C formed integrally in the clipper 70.

HANDLE DRIVE END LATERAL WALLS

Referring now to FIGS. 1 and 2 and concerning the preferred embodiment lateral walls of the drive end cavity, ascending from and preferably partially conjoined with the rectangular floor 74 on its two short sides (best seen in FIG. 1) are opposing walls that are substantially vertical and create the interior "sides" of the integrally formed drive end cavity. These two lateral walls extend upward to form the apex of the handle drive end 71 and preferably are substantially flush with and integrally formed with the pivotable blade assembly 40 when parked in its second position 2 (FIG. 2). The left interior wall of the drive end cavity is conjoined with the left lateral face of the clipper 70 and also conjoined with the left side of the rectangular floor 74. The right interior wall of the drive end cavity preferably is conjoined with the right lateral face of the clipper 70 and also conjoined with the right side of the rectangular floor 74.

Referring still to FIGS. 1 and 2, when viewed from within the interior of the drive end cavity, each of the lateral walls appears as a solid plane having a substantially vertical rise that forms a contoured apex and spans the depth of the drive end cavity. Each of said walls preferably has formed integrally onto itself a pivot axle hole 51 and a safety formation 53. The apex of the clipper handle 71 preferably is rounded (best seen in FIG. 1) to be substantially smooth and flush with the "top" of the blade assembly 40 when parked in its second position 2 (best seen in FIG. 2), thus providing the user with substantial skin protection and comfort should the user utilize the clipper system while the reciprocating blades are in operation and without the protection area guard/gauge.

HANDLE DRIVE END POSTERIOR WALL

Referring now to FIGS. 1, 3 and 9 and concerning the posterior wall DE2, 79 of the drive end cavity, this wall ascends from the floor 74 and is inclined at a slight angle designed integrally with the shape of the posterior of the blade assembly 40 while parked in its second position 2 (best seen in FIG. 9). The uppermost portion 79 of said posterior wall of the drive end cavity is sharply angled outward and toward the posterior face of the clipper handle 70 to accommodate the first position 1 pivot of the pivotable blade assembly 40 (best avert in FIG. 9). When viewed from within the interior of the drive end cavity, the posterior wall DE2, 79 appears as a solid surface comprised or two intersecting planes DE2, 79 spanning the width of the drive end cavity. The slopes of said planes are determined by the 35-degrees arc of pivot 3 (FIG. 9) of the pivotable blade assembly 40 in that the entirety at the posterior wall DE2, 79 preferably tightly accommodates the pivot action of said blade assembly. The preferably close tolerance or tight fit between the posterior wall DE2, 79 and the pivotable blade assembly 40 (FIG. 9) ensures an integral pivot arc stop means 79 (best seen in FIG. 3) for the arc of pivot 3 (FIG. 9) associated with the blade assembly 44, thus providing safety for the user and enhancing the functionality of the pivotable blade assembly 40 by ensuring that substantial contact is maintained between the pivotable blade assembly 40 and the drive actuator member 89 during any of the pivot action of said blade assembly. This posterior wall DE2, 79 of the drive end cavity is preferably conjoined with the posterior face of the clipper handle 70 and also conjoined with the posterior side of the rectangular floor 74.

HANDLE DRIVE END ANTERIOR WALL

Referring now to FIGS. 1 and 3 and concerning the frusts-pyramidal portion, or pyramid-like portion, of the anterior wall 61A, DE3 (FIG. 1) of the drive end cavity, said portion 61A preferably is integrally shaped to accommodate the full pivotable motion of the blade assembly 40 (FIG. 3) and to accommodate the offset cam eccentric 87 and drive actuator member 89 preferably extending through the drive end floor 74 (best seen in FIG. 1). Said portion 81A is deeply angled on ascent from the drive end floor 74 toward the anterior of the clipper handle 70 (best seen in FIG. 3). More specifically, the ascent of said portion 61A of the drive end cavity rises to a height approximately half the height of the blade assembly 40 whereupon the slope of said portion abruptly increases to mimic the anterior face of the housing of the blade assembly 40 and continues to a height just beneath the bottom blade of the blade assembly 40 (best seen in FIG. 3).

Referring now to FIGS. 1, 3, 7 and 9, the slopes of the pyramid-like portion 61A (best seen in FIG. 1) are determined by its lateral, posterior edges (best seen in FIG. 3). Said slopes preferably are also determined by the anterior contouring of the housing 50 of the pivotable blade assembly 40 (best seen in FIG. 7) such that the posterior slopes of said portion 61A preferably tightly accommodate the anterior contouring of the pivotable blade assembly 40 during the entire 38-degree arc of pivot 3 (FIG. 9) associated therewith.

Referring now to FIGS. 3, 7 and 9, the preferably tight tolerance or fit between the frusta-pyramidal portion 61A and the pivotable blade assembly 40 enhances the aerodynamics of the first suction formation 61A in that the housing 50 (FIG. 7) of the blade assembly 40 serves to directionally guide suctioned air 60 into said formation. Said tight tolerance also enhances the ability of the relationship between the first suction formation 61A and the blade assembly 40 to extremely limit the volume of suctioned air 60 to a substantially focused point or intake at the cutting blades of the pivotable blade assembly 40 whether a is parked in its first position 1 or parked in its second position 2. Therefore, it is known that during manufacture and assembly minimized tolerance between the blade assembly 40 and the first suction formation 61A against which it is secured, as opposed to a large gap that would cause inefficiency, provides generally superior suction of the cutting portion of the blade assembly 40.

Referring now to FIGS. 1, 2, 3 and 9, the anterior wall 61A, DE3 of the drive end cavity in its entirety includes a "rise" that when viewed frontally as a cutaway 61A (best seen in FIG. 2) is preferably triangular with a flattened apex having a width of approximately three-sixteenths inch at its apex and having a width of approximately one and one-quarter inches at its basal intersection with the plane of the drive end floor 74. When the preferred embodiment of said rise is viewed laterally as a cut-away (best seen in FIG. 3) it is polygonal in shape having a depth of approximately five-sixteenths inch at the apex and at the midpoint and having a depth of approximately nine-sixteenths inch at its basal intersection with the plane of the drive floor 74. It is known that the notably polygonal shape at the lateral edges of the first suction formation 81A (best seen in FIGS. 3 and 9) serves to channel and redirect air suctioned from the cutting portion of the blade assembly 40 in a bilaterally deferred manner toward the vertically central but laterally exterior portions of the clipper 70. Said rise is preferably molded as a solid formation but contemplated also as a hollow formation with no appreciable difference in performance.

Referring now to FIGS. 1, and 3, the "rise" 61A referenced in the above paragraph (best seen in FIG. 1) comprises the most interior portion of the anterior wall 61A, DE3, and is the portion designated the first suction formation 61A. Said formation is not conjoined with the anterior side of the rectangular floor 74 as preferably an injection mold seam exists there. Said formation preferably is conjoined with the most exterior portion DC3 of the anterior wall of the drive end cavity, and preferably is conjoined also with the anterior face of the clipper handle 70.

Referring now to FIGS. 1, 3 and 4, when viewed from within the interior of the drive end cavity, the most interior portion 61A of the alliance wall 61A, DE3 appears as a frusta-pyramidal shape 61A having two distinct slopes intersecting concavely at a midline that is parallel with the floor 74 of the drive end cavity, said shape being abutted and preferably conjoined to a wall-like structure DE3 there behind. Furthermore, the frusta-pyramidal shape 61A projects inwardly from the wall-like structure DE3 toward the interior of the drive end cavity. It is known that the first suction formation 61A, has an integral relationship with the contoured housing 50 of the pivotable blade assembly 40 (FIG. 4), each functioning in conjunction with the other to streamline suctioned air into the second suction formation 61B whereupon it is deferred onward toward evacuation from the clipper handle 70.

Referring now to FIG. 1, the preferred embodiment frusta-pyramidal shaped rise 61A conjoins with a more wall-like structure DE3 of substantially vertical slope ascending behind said rise 61A to a height that is substantially flush with the apex of said rise 61A. The slope of said wall-like structure DE3 is determined by the angle at which the frusta-pyramidal shape 61A descends from its apex toward the abutted edges or two preferably rectangular shaped hollows 61B that are bilaterally adjacent to its base. Each of said hollows 61B abuts the anterior wall DE3 at opposing sides of said wall, each also abuts its respective left or right lateral wall of the interior of the drive end cavity, and each also abuts opposing ends of the anterior of the rectangular floor 74 whereupon preferably an injection mold seam is found. Each of said hollows integrally comprises the entrance to the bilateral conduits that are the second suction formation 61B.

HANDLE DRIVE END SAFETY VENTING

Referring now to FIGS. 1 and 3, bilateral safety venting 61D is comprised of bilateral holes formed integrally in both lateral force of the clipper handle drive end 71 (best seen in FIG. 1), said holes preferably formed as a polygonal shape mimicking the polygonal shape described previously as the lateral view of the first suction formation 61A. In the preferred embodiment, said polygonal shape is suitable in dimension for at least halving the optimum intake of the clipper 70. More specifically, the present invention includes bilateral safely venting 61D the function of which is nullified by use of a guard/gauge such that said guard/gauge installed on the clipper handle 70 blocks the draw of suctioned air 60 through said safety venting thus promoting a maximum flow of suctioned air 60 across the cutting portion of the blade assembly 40 and into the first suction formation 61A.

Referring now to FIGS. 1 and 4, in the preferred embodiment of the present invention pivotable blade hair clipper and suction collection system the inner volume of all suction componentry is contemplated and designed such that the present invention has as its smallest suction component, with respect to inner volume, the second suction formation 61B. Said inner volume is calculable and preferably all other integrally functioning suction components are sufficient in their size and shape to at least equal the optimum intake of said formation. More specifically, each of the two holes comprising the bilateral safety venting 61D is sufficient in size and shape to at best halve the optimum intake of suctioned air 60 through the clipper 70, thus beneficially deterring in its entirety the suctioned intake at the cutting portion of the blade assembly 40 until such time as a guard/gauge is installed on the clipper 70, and thus providing the user with an optimal safety precaution to prevent unwanted draw by suctioned force of the skin surface into the cutting blades.

HANDLE DRIVE END SAFETY FORMATION

Referring now to FIGS. 1, 2, 3, and 6, the lateral walls of the clipper handle drive end 71 have located bilaterally thereon a safety formation 53 that readily engages a corresponding dual position formation 52 (FIG. 6) located on each of the lateral exteriors of the pivotable blade assembly 40. The safety formation 63 is bilaterally symmetrical and comprises a raised nodule located on each of the lateral interior walls at the drive end cavity, said nodule serving as a male part. The safety formation 53, or nodule, corresponds with and is positioned integrally with the holes comprising the duel position formation 62 (FIG. 6). The dual position formation 52 is comprised of holes, but also is contemplated as concavities rather than holes. Said dual position formation functions as a female counterpart to tightly accommodate the safety formation 53 formed in the handle drive end 71. Said safety formation 53 functions to tightly park the pivotable blade assembly 40 into one of its two positions 1, 2 by engaging the dual position formation 62 at either of both of sold positions.

HANDLE DRIVE END GUARD/GAUGE SECURING MEANS

Referring now to FIGS. 3, 16, 17, 21 and 26, in the preferred embodiment of the present invention, a clipper handle guard/gauge securing means 75 is located on and preferably molded integrally with the anterior face of the handle drive end portion 71. Said securing means 75 corresponds integrally with respect to position and formation to the guard/gauge securing means 77 on the guard/gauge 113, 114, 116, as referenced previously in the section designated "Guard/Gauges," and on the skin guard SG1 as referenced previously in the suction designated "Skin Guard."

Referring now to FIGS. 1, 3 and 17 the function of the clipper handle guard/gauge securing means 75 (FIG. 3) and the corresponding and preferably tightly fitting guard/gauge securing means 77 (FIG. 17) is to prevent unwanted slippage of the guard/gauge 113 while installed an the handle drive end 71.

Additionally, at the junction of the handle drive end 71 and the handle motor house 72 preferably is formed integrally on the anterior and posterior faces of the clipper 70 a lip, or ridge, or shelf, or other means designated the clipper handle guard/gauge stop means 76 (best seen in FIGS. 1 and 3). The function of the clipper handle guard/gauge stop means 78 is to provide a stop point when installing the guard/gauge on the handle drive end 71.

Referring now to FIGS. 3, 10, 17, 21 and 25, in its preferred embodiment the present invention clipper handle guard/gauge security means 76 comprises an elongate concavity substantially centered horizontally on this anterior face of the handle drive end portion 71, parallel to the plane of the floor 74 of the handle drive end 71, and approximately one fourth the width of the clipper 70. Said securing means 75 is preferably positioned vertically approximately one-quarter inch above the plane at the floor 74 of the handle drive end. Furthermore, the guard/gauge securing means 77 located on the guard/gauges 113, 114, 115 and skin guard SG1 is preferably formed convex and elongate corresponding as a tightly fitting male counterpart to the concavely formed securing means 75 described above. Each of said female and male securing means 75, 77 preferably is integrally designed with its counterpart securing means with respect to shape, dimension, position and function.

HANDLE DRIVE END PIVOT AXLE COMPONENTRY

Referring now to FIGS. 1, 3, 6 and 9, in the preferred embodiment of the present invention preferably formed integrally in each of the lateral walls of the handle drive end portion 71 is a bilaterally symmetrical pivot axle hole 51 that functions to tightly secure a preferably threaded pivot axle male part 42 into a preferably correspondingly threaded pivot axle female part 41 by insertion through said axle hole formed on the handle drive end portion 71, then through the corresponding bilaterally symmetrical pivot axle hole 51 in the pivotable blade assembly 40, and then threading the parts together.

Referring now to FIG. 9, in the preferred embodiment of the present invention the pivot axle location is precisely centered in a 360-degree arc, or circle, designated the arc of pivot 3. In the preferred embodiment said arc functionally spans thirty-five degrees. Also in the preferred embodiment the pivot axle hole 51 is precisely located and configured to tightly accommodate a one-eighth inch diameter axle.

Referring now to FIGS. 3, 6 and 9, the preferred embodiment pivotable blade 40 assembly can be pivoted within the drive end cavity around only one horizontally oriented axis, said axis determining precisely the position of the pivot axle hole 51 in each of the handle drive end 71 and the housing 50 of the blade assembly 40. In the preferred embodiment of the present invention, the pivot axle hole 51 in each of the lateral walls of the drive end 71 exactly corresponds to the pivot axle hole 51 in the corresponding lateral wall of the pivotable blade assembly 40 with respect to position and dimension. Additional variances or tolerances in forming the pivot axle hole 51 preferably are extremely minimized thus making the pivotable motion of the blade assembly 40 precise and stable.

HANDLE MOTOR HOUSE PORTION

Referring now to FIGS. 2 and 28, in the preferred embodiment the clipper motor 80 is housed within the motor house 81 in such a way that airflow 60 is suctioned around the motor house 81 by way of the designated second suction formation 61 thus allowing clipped hair debris to pass through the clipper unit 70 while not affecting motor operation and still achieving the smallest size clipper unit possible. Furthermore, the motor shell 88 is integrally designed with a cam eccentric 87 and drive actuator member 89 that extend upward through the floor 74 of the drive end 71, thus the preferably rotary clipper motor 80 provides reciprocative motion to the blade assembly 40 there secured. The arrangement and operation of the motor 80, the drive shaft 88, the cam eccentric 87 and the drive actuator member 89 are similar to rotary motor componentry which is well known in the art. Said rotary motor componentry comprises the preferred embodiment motor componentry of the present invention especially because such a rotary-type motor provides the user with a more comfortable clipper handle shape, as well as generally less weight, noise and vibration, then does its electromagnetic counterpart. Said motor is preferably of the rotary type but is also contemplated as the electromagnetic type.

Referring now to FIG. 28, the preferred embodiment motor 80 is powered by electrically drawing on vacuum motor wiring 104 in a known way 91. This known method 91 of wiring 104 is also described as a supply 104 powering the vacuum motor 100, which supply 104, 84 also travels through the interior of the suction base 66 to supply the clipper motor 80. In its preferred embodiment, this anticipated means of powering the clipper 70 enables a removable electrical power supply cord designated 84 with male 85, 105 and female 86, 106 connection to pass from the vacuum motor house 101 to the clipper motor house 81 by way of the interior of the suction hoses 66 and provides maximum clipper mobility while the clipper 70 is in operation. The detachable power supply cord 64 is equally well described as power supply wiring 84 traveling within or housed fixedly within the suction hose 66, having subsequent wiring connectors 85, 105 at each of its ends. Preferably a power supply cord 84 connected to and powered by the vacuum hair collection canister 90 in a known manner 91, by the use of engaging connection 85, 105, 86, 108, travels internally from end to end of the suction hose 66 to power the motor switch 83 and motor 80 located within the clipper motor housing 81. Contemplated, however, is an alternative embodiment wherein said wiring is external to the suction hose 66 and attached thereto by clips (contemplated, but not shown), but such method appreciably hinders clipper mobility in that an external hose and an external cord are now both present during operation of the clipper 70 as opposed to the preferred embodiment wherein only an external hose is present.

Referring now to FIGS. 2 and 28, the motor 80 is wired by means known in the art to a switch 83 and to a connector preferably of female design 88 that engages a corresponding male connector 85 such that an electrical supply cord 84, attached to said male connector extends out of the clipper handle butt portion 73. Said supply cord preferably extends onward by way of the interior of the suction hose 66 toward a similar means of electrical connection 105, 106 within the vacuum hair collection canister 90. The preferred embodiment means for wiring both the clipper motor 80 and the vacuum motor 100 are well known in the art and are intended to originate from the same power source thus allowing the user to provide a power supply to the present invention by way of a single electrical outlet though alternative means of powering the invention are contemplated as well including, but not limited only to, rechargeable batteries for powering the clipper motor 80. It a known that in a contemplated embodiment clipper handle 70 having rechargeable means of operation, for example such battery pack componentry is insufficient to operate the clipper motor 80 for extended periods of time and negatively affects ergonomic balance and optimum size of the clipper handle 70.

Referring now to FIGS. 1, 2 and 3, when viewed from the front, the preferred embodiment motor house 81 appears symmetrical and centrally located, and is preferably formed as a six sided continuous wall of sufficient dimensions to house the motor 80 (best seen in FIG. 2). When viewed from the side, at the junction of the handle drive end portion 71 and the handle motor house portion 72 preferably a formed integrally on the anterior and posterior faces of the clipper 70 a substantially flat lip, or ridge, or shelf or other means designated the clipper handle guard/gauge stop means 78 (best seen in FIGS. 1 and 3). The function of the clipper handle guard/gauge stop means 78 is to provide a stop point when installing the guard/gauge on the handle drive end 71.

Referring now to FIG. 2, the motor house 01 preferably is formed integrally into the handle portion of the clipper 70 and made of durable, impact-resistant molded polymeric or plastic material as is known in the art such that seams or joints inherent in the injection molding process are minimized and do not inherently interfere with the aerodynamics of the main suction formation 61A, or do not interfere more specifically with the function of the second suction formation 61B that is integrally a part of the motor house 81. The dimensions and configuration of said second suction formation are sufficient for passing through itself a volume of air intended for evacuation of clipped hair debris from the cutting portion of the blade assembly 40 through the clipper handle 70 and then onward by way of a suction hose 66 toward final evacuation.

Referring still to FIG. 2, a break in wall continuity exists at the apex of the motor house 81 as a preferably round hole dimensioned and located to allow the extension of the drive actuator member 89 through the floor 74 of the drive end 71. Also, a break exists in the base of the otherwise preferably continuous six-sided wall of the motor house 81. The basal break preferably is a round hole sufficient in dimension and shape for passing through itself and securing into the hollow interior of the motor house 81 electrical componentry associated with and intended for powering the clipper motor 80. More specifically, the preferred embodiment motor house 81 has mounted in a hole in its base a female connector 88. Additionally, ventilation is present in the form of small holes (not shown) located basically in the motor house walls. The preferably continuously molded form of the motor house 81, excepting the holes described, contributes to the efficiency of the vacuum suction capability of the present invention pivotable blade hair clipper and suction collection system by preventing the draw of airflow 68 and clipped hair debris from passing into the motor house and by streamlining said airflow and clipped hair debris around the motor house 81 and onward to the suction hose 66 toward final evacuation.

Referring still to FIG. 2, in the present invention the preferred method of mounting a power supply connector of preferably female design 88 to the interior of the motor house 81 is to insert said female connector into said motor house by way of the preferably hole-shaped wall break that exists in the base of said motor house. Said female connector preferably is mounted and secured were by a connector mounting means 82 such as a neoprene fitting or other means known in the art. Also, said female connector preferably protrudes from the base of the motor house 81 sufficiently to engage its corresponding male connector 85, and is sufficiently stable and strong and secure for the user to engage upon it said male connector without dislodging it or otherwise compromising the intentions of the preferred method of power supply. Similarly, the preferred method for mounting the motor 80 within the interior of the motor house 81 is accomplished by means known in the art and by means that will prevent user access to said motor and its associated electrical componentry, excepting the preferably female connector 85 and switch 83, under normal operating conditions.

Referring now to FIGS. 1 and 2, the preferred embodiment motor switch 83 is located below the motor 80 within the triangular shaped hollow specifically accommodating electrical wiring componentry associated therewith. As demonstrated in FIG. 1, the switch has only simple "ON/OFF" designation, said switch preferably being wired by means know in the art to the main switch located near the vacuum motor housing as described in the section designated "Vacuum Canister." The clipper motor switch 83 preferably protrudes through the posterior face at the clipper 70 (FIG. 1) for user access.

HANDLE BUTT PORTION

Referring now to FIGS. 2 and 3, the present invention pivotable blade hair clipper and suction connection system includes a clipper handle butt portion 73 having a formation suitable for suction base connection 61C and for final evacuation of suctioned airflow 60 from the clipper handle 75. More specifically, the clipper handle butt portion 73 serves to join the bilaterally halved second suction formation 61B in a manner suitable for suction hose connection. Viewed from the side (best seen in FIG. 3), the interior of the clipper contains substantially hollow space 61C inherently formed by its motor house 81 and the injection molded plastic material comprising the faces of said clipper. Viewed from the front (best seen in FIG. 2), said motor house and said faces of the clipper form a substantially hollow space also such that the second suction formation 61B is deferred bilaterally into a single hollow formation 61C and onward to the suction hose 66.

Referring now to FIGS. 2 and 3, the preferred embodiment clipper handle 70 has within the formation 61C ample space for the user to readily engage the male connector 85 into, or readily disengage it from, the corresponding female connector 86 secured at the base of the motor house 81. Additionally, the handle butt portion 73 is integrally formed as a tubular extension having on it connector clips 63 such that a correspondingly formed fitting or connector 62 made preferably of flexible rubber can be installed thereupon and secured by means of the clips 63. Said clips preferably comprise a smooth and rounded ridge sufficient in shape, dimension and location for ideal engagement and disengagement of the correspondingly formed rubber connector 62.

Referring now to FIGS. 2, 3 and 28, said tubular extension preferably is sufficient in its height (best seen in FIG. 2) to extend the suction hose 66 away from the clipper handle 70 such that ergonomic balance or leverage can be maintained, complementary to the necessarily downward force of gravity applied by the weight of the suction hose against the clipper handle 70, under conditions of normal operation in the user's hand. Unlike some prior art clipper handles, the preferred embodiment clipper handle 70 of the present invention evenly distributes its weight and offsetting gravitational forces to provide the user with a feeling of balance and control while utilizing the invention. Furthermore, in the preferred embodiment the tubular extension has an approximate diameter of three-quarters inch and is sufficient in volume to accommodate the optimum intake of the vacuum motor 100 (FIG. 26). Thus, is provided the means for attaching the suction hose 66 to the clipper handle butt portion 73.

SUCTION HOSE

Referring now to FIGS. 2, 13, 14 and 28, in the preferred embodiment of the present invention the suction hose 66 preferably is made of light gauge wire and vinyl or other materials known in the art for their very high flexibility and light weight. The detachable power supply cord 84 is equally well described as power supply wiring 64 traveling within or housed fixedly within the suction hose 66, having subsequent wiring connectors 83, 105 at each of its ends. Additionally, the preferred embodiment suction hose has an appreciably large inner diameter not less than three-quarters inch and is highly flexible such that, as described previously, a removable electrical power supply cord 84 travels from and to and within it. Such method is intended to provide maximum mobility and ergonomic balance of the clipper 70 under conditions of normal operation in the user's hand.

Referring now to FIGS. 2, 13 and 14, the preferred embodiment suction hose 66 is connected at either end to each of both the clipper 70 at its butt portion 73 and the vacuum hair collection canister 00 at the suction head portion 99 by a flexible rubber connector 62, 64 integrally contoured at its interior to fit snugly onto the handle butt portion 73 and engage there the suction hose central clip formation 83 such that the snug fit is substantially airtight where the mouth of the hose 66 attaches at the butt 73 of the clipper 70. The connector 62 is externally shaped as a comfortable and esthetically appealing extension of the clipper handle 70 (best seen in FIG. 2). Said connector is shaped at its base to provide for utilitarian play of the suction hose 66 installed therein, which play naturally occurs while the clipper 70 is in operation and/or is mobile.

VACUUM CANISTER

Referring now to FIGS. 14 and 28, in the preferred embodiment present invention the vacuum hair collection canister 90 comprises storage capacity 96, 97, a vacuum suction head portion 88 having suction hose connector means 64 and connector clip formations 65, a vacuum motor house 101 having a motor 100 and switch 107, and wiring 84, 91, 104 of means known in the art to be sufficient to power both the vacuum motor 100 and the clipper motor 80. The vacuum hair collection canister 90 also includes a filtration means 93 (FIG. 14) sufficient to collect clipped hair debris evacuated from the cutting portion of the blade assembly 40 through the clipper handle 70 and through the suction hose 88 into said canister 90.

Referring still to FIGS. 14 and 28 more specifically, wiring 84, 91, 104 of means known in the art preferably supplies power by way of a single electrical outlet initially to the vacuum motor 100 and then to the clipper motor 80 by continuing the electrical power supply 104 to the vacuum motor switch 107, the vacuum motor 100, the conventional power transfer means 91, 84 known in the art and the male and female connectors 108, 106. From this point, the power supply travels preferably through the interior of the suction hose 66 toward connectors 85, 86 that supply the clipper motor 80 and switch 83 thus driving the blade assembly 40. Also contemplated for use in the present invention is wiring of means known in the art to be sufficient to power both the vacuum motor 100 and the clipper motor 60 but not limited to a single electrical outlet and/or not limited to traveling through the interior of the suction hose 66.

Referring now to FIG. 28, the vacuum hair collection canister 90 provides the user with a personal sized means for evacuating and collecting clipped hair debris from the skin surface and from the work area while using the clipper unit 70. The vacuum canister 90 preferably is light-weight, provides quiet operation, and includes: storage means 98 for the clipper unit; storage means 97 for the suction hose 66; a built-in minor 98; varied length guard/gauges 113, 114, 115 and skin guard SG1; and varied attachments or accessories including but not limited only to a back-reach attachment 112, a cleaner brush 116 and blade lubricating oil 117. Such attachments or accessories are contemplated to provide the user with, for example, a means to hold up a built-in mirror 98 housed within the light-weight hair collection canister 90 for viewing otherwise difficult-to-see body parts such as the back while utilizing the clipper unit with the attachments such as the back-reach attachment and a guard/gauge to trim hair on the back or on the neck and shoulders. Such a scenario inherently provides the user with added safety and comfort in that one hand is used to control the location of the canister unit 90 and one hand is used to control the location of the clipper unit 70 at all times, with the suction hose 66 remaining safely and not overextended there between. Thus, the canister unit need never be caused to fail, and the clipper unit need never be pulled out of control due to overextension of the suction hose. Therefore, the preferred light-weight portability and built-in mirror 98 of the canister unit 90 are integral to the preferred safest operation of the invention.

Referring now to FIGS. 13 and 14, the preferred method of attachment for the suction hose 66 to the canister suction head portion 99 is similar in design to the method described above for attachment to the clipper handle butt portion 73 in the section designated "Suction Hose." Pertinent components for attachment of the suction hose 66 to the canister suction head portion 99 are the suction hose 66, the flexible rubber connector 64, the canister suction head portion 99, the clip formation 66, and the preferably female connector 106 having a mounting means 82 of neoprene or other material and having its corresponding male connector 105.

Referring now to FIG. 14, this vacuum hair collection canister of the type suitable for use in the present invention is generally designated 90 and preferably is made of durable, impact-resistant molded polymeric or plastic material as is known in the art. The overall appearance of the preferred canister is rectangular and has the approximate dimensions of 9" w×2.6" h, when viewed laterally. The depth (not shown) of the canister is preferred to be approximately 4.35 inches providing ample space for a vacuum motor plus storage capacity as described above. Viewing FIG. 14, it is seen that the right lateral side denotes the base 102 of the vacuum motor house serving a means for securing the motor 100 into the motor housing 101 by way of screws 108 that are also contemplated as clips, tabs, or other fastening means. Said base is vented to allow for the escape of vacuum exhaust 109. Additionally, in the present embodiment are provisions including but not limited only to a readily accessible filtration means 63, compartment access 92 such that storage 06, 07 and suction hose connection 64, 65 and wiring connectors 105, 106 preferably are accessible to the user, as well as a built-in mirror 98.

Referring now to FIGS. 14 and 28, preferably appearing on the top face of the canister, but wired internally, is a motor switch 107. Said switch preferably provides several settings including: "on, " "off," "suction high," "suction low," "clipper with suction," and "clipper without suction." The variability in the preferred embodiment vacuum motor switch allows the user to power the invention under several scenarios including using the clipper unit with air suction or without, and including varying the air suction from high to low, and including turning on or off the invention at a single switch. More specifically, the clipper motor switch 83 preferably is wired to the vacuum motor switch 107 by means known in the art such that when the clipper motor switch is left in the "on" position the vacuum power supply switch functions to "turn it on" or "turn it off" from the canister location, rather than necessitating that both the clipper motor switch and the vacuum motor switch be independently switched to their "on" or "off" positions. Conversely, if the user prefers additional cautionary measures when operating the clipper unit, the clipper motor switch 83 can be left in the "off" position necessitating that it be independently "turned on" at the user's discretion in order to operate the clipper unit 70. Additionally, the switch functions are describe as including variability in switch functions to power the vacuum and clipper switches and motors either separately or in combination with one another.

While a particular embodiment of the present invention pivotable blade hair clipper and suction collection system has been shown and described it will be appreciated by those skilled in the art that changes and modifications maybe made thereto without departing from the invention in its broader aspects and as set forth in the following claims.

What is claimed is:

1. A pivotable blade hair clipper and suction collection system comprising:

a clipper handle having a drive end portion, a safety formation, a safety venting, a main suction formation, a switch, a clipper motor, a butt portion, and guard/gauge securing means;

a pivotable blade assembly having a reciprocating blade and a forced blade with spring means applying biasing force there against, having said blades partially enclosed by a housing that serves to guide suctioned air into said clipper handle, and with said housing having upon it a dual position formation, a pivot axle and pivot tabs;

a suction hose having suction hose connector means at each of its ends, having power supply wiring within said suction hose, and having subsequent wiring connectors at each of said ends;

a vacuum hair collection canister connectable to said copper handle by way of said suction hose connector means, having a vacuum motor, having wiring sufficient to power both said vacuum motor and said clipper motor, having said wiring further defined as a supply powering said vacuum motor and which supply also travels through the interior of said suction hose to supply said clipper motor, having a switch and variability in switch functions to power said vacuum motor and said clipper motor, having filtration means sufficient to collect clipped hair debris, evacuated from the cutting portion of said blade assembly through said clipper handle and through said suction hose, and also having light-weight portability and a built-in mirror;

a back-reach attachment having a secure means of installation that is rigid and stabilizing at the clipper, plus variations to its angle of attachment for maximum user safety, comfort and control; and guard/gauges for engaging said drive end portion at said guard/gauge securing means, and being engineered to block the flow of suctioned air into said safety venting, and being of a shape that is either intended to comb the body surface or to roll within a space equivalent to the depth of said clipper while achieving a predetermined cut length and simultaneous evacuation of clipped hair debris from the akin surface and work area.

2. The pivotable blade hair clipper and suction collection system as defined in claim 1 wherein said drive end portion further includes a drive actuator member extended therein, and said blade assembly further includes a blade actuator having a cam follower to support and guide said reciprocating blade reciprocally along said fixed blade and to maintain substantial contact with said drive actuator member during the arc of pivot of said blade assembly.

3. The pivotable blade hair clipper and suction collection system as defined in claim 1 wherein said safety formation comprised in said drive end portion is integrally designed with said dual position formation comprised in said housing such that imparting upward or downward finger pressure on said pivot tabs engages said housing into or disengages said housing from at least two angles for cutting at said drive end portion.

4. The pivotable blade hair clipper and suction collection system as defined in claim 1 wherein said safety venting is comprised of at least one hole being formed integrally in said clipper handle and being formed sufficiently for deferring suctioned intake at the cutting portion of said blade assembly, which hole serves as a safety precaution to prevent unwanted draw by suctioned force of the skin surface into the cutting blades.

5. The pivotable blade hair clipper and suction collection system as defined in claim 1 wherein said main suction formation is comprised of at least one hollow formed integrally in said clipper handle and adequate for immediately suctioning away hair clippings from the cutting portion of said blade assembly and fluidly through said clipper handle.

6. The pivotable blade hair clipper and suction collection system as defined in claim 1 wherein a hollow formation comprises said butt portion such that said suction hose connector means is attachable thereat, and such that at least one of said wiring connectors is attachable threreat for powering said clipper motor.

7. The pivotable blade hair clipper and suction collection system as defined in claim 2 wherein said housing that serves to guide suctioned air into said clipper handle is comprised of solidly formed faces at the anterior, posterior and lateral portions of said housing that, in combination with the tight tolerance of said housing within said clipper handle, embody the aerodynamic intention of said pivotable blade assembly.

8. The pivotable blade hair clipper and suction collection system as defined in claim 1 wherein said variability in switch functions is comprised of any or all of a vacuum motor and switch operating separately from or in combination with a clipper motor and switch said elements providing any or all of variable motor speed, on, off, suction high, suction low, clipper with suction, or clipper without suction.

9. The pivotable blade hair clipper and suction collection system as defined in claim 1 wherein said built-in mirror is comprised of a mirror housed within said canister for viewing otherwise difficult-to-see body parts such as the back while utilizing said clipper.

10. The pivotable blade hair clipper and suction collection system as defined in claim 1 wherein said secure means of installation that is rigid and stabilizing at the clipper comprises a handle having secure attachment at said clipper for extensible reach of said clipper to the back or to another difficult-to-reach body surface, said handle being shaped and angled to provide utility, safety, comfort and control for its user.

11. The pivotable blade hair clipper and suction collection system as defined in claim 1 wherein said vacuum hair collection canister is comprised of storage capacity, vacuum suction head portion, suction hose connector means, connector clip formations, vacuum motor house, motor and switch, filtration means, built-in mirror, and wiring sufficient to power both the vacuum motor and the clipper motor.

* * * * *

UNITED STATES PATENT AND TRADEMARK OFFICE

CERTIFICATE OF CORRECTION

PATENT NO. : 6,935,028 B2
APPLICATION NO. : 10/371583
DATED : August 30, 2005
INVENTOR(S) : John Cutting It is certified that error appears in the above-identified patent and that said Letters Patent is hereby corrected as shown below:

Column 2, line 39, the text reading “90 degrees” should read --80 degrees--.

Column 4, line 9, the text reading “dusting blades” should read --cutting blades--.

Column 27, line 39, the claim text reading “copper handle” should read -- clipper handle--.

Column 27, line 63, the claim text reading “akin surface” should read --skin surface--.

Column 28, line 35, the claim reference numeral “2” should read --1--.

Signed and Sealed this

Thirteenth Day of May, 2008

JON W. DUDAS
*Director of the United States Patent and Trademark Office*